US009682278B2

(12) United States Patent
Jones

(10) Patent No.: US 9,682,278 B2
(45) Date of Patent: Jun. 20, 2017

(54) EXERCISE APPARATUS

(71) Applicant: Bryan A. Jones, Laveen, AZ (US)

(72) Inventor: Bryan A. Jones, Laveen, AZ (US)

( * ) Notice: Subject to any disclaimer, the term of this patent is extended or adjusted under 35 U.S.C. 154(b) by 191 days.

(21) Appl. No.: 14/605,683

(22) Filed: Jan. 26, 2015

(65) Prior Publication Data

US 2016/0213971 A1 Jul. 28, 2016

(51) Int. Cl.

| | |
|---|---|
| ***A63B 23/04*** | (2006.01) |
| ***A63B 22/00*** | (2006.01) |
| ***A63B 22/16*** | (2006.01) |
| ***A63B 22/20*** | (2006.01) |
| *A63B 71/06* | (2006.01) |
| *A63B 21/008* | (2006.01) |
| *A63B 23/00* | (2006.01) |
| *A63B 21/02* | (2006.01) |

(52) U.S. Cl.

CPC ..... *A63B 22/0061* (2013.01); *A63B 22/0023* (2013.01); *A63B 22/0069* (2013.01); *A63B 22/16* (2013.01); *A63B 22/205* (2013.01); *A63B 22/208* (2013.01); *A63B 21/0083* (2013.01); *A63B 21/028* (2013.01); *A63B 22/0005* (2015.10); *A63B 22/0012* (2013.01); *A63B 71/0622* (2013.01); *A63B 2023/003* (2013.01); *A63B 2071/0625* (2013.01); *A63B 2225/093* (2013.01)

(58) Field of Classification Search

CPC ..... A63B 69/18; A63B 69/182; A63B 69/185; A63B 69/187; A63B 22/0007; A63B 22/001; A63B 22/0012; A63B 21/4029

See application file for complete search history.

(56) References Cited

U.S. PATENT DOCUMENTS

| | | | | |
|---|---|---|---|---|
| 326,247 | A * | 9/1885 | Root | A63B 21/00178 482/131 |
| 3,912,260 | A * | 10/1975 | Rice | A63B 69/18 482/4 |
| 3,929,329 | A * | 12/1975 | Rivera | A63B 21/05 482/146 |
| 4,286,782 | A * | 9/1981 | Fuhrhop | A63B 21/078 482/103 |
| 4,781,372 | A | 11/1988 | McCormack | |
| 4,846,463 | A | 7/1989 | Kleinnibbelink | |
| 4,915,373 | A | 4/1990 | Walker | |
| 5,031,898 | A | 7/1991 | Anthony | |
| 5,224,909 | A | 7/1993 | Hamilton | |

(Continued)

*Primary Examiner* — Loan H Thanh
*Assistant Examiner* — Rae Fischer
(74) *Attorney, Agent, or Firm* — Michael W. Goltry; Robert A. Parsons; Parsons & Goltry

(57) ABSTRACT

An exercise apparatus includes a base having a rear end and a front end. A support extends upright from the front end of the base and supports a handle assembly disposed at an elevated location relative to the front end of the base. A framework, between the rear end of the base and the front end of the base, is mounted to the rear end of the base for movement of the framework between a lowered inclined position relative to the rear end of the base and a raised inclined position relative to the rear end of the base, and for side-to-side pivotal movement of the framework about a longitudinal axis. Opposed foot supports are mounted to the framework on either side of the longitudinal axis for movement in reciprocal directions relative to the handle assembly.

24 Claims, 19 Drawing Sheets

(56) References Cited

U.S. PATENT DOCUMENTS

| | | | | |
|---|---|---|---|---|
| 5,342,264 | A | 8/1994 | Gordon | |
| 5,656,003 | A | 8/1997 | Robinson et al. | |
| 5,665,033 | A | 9/1997 | Palmer | |
| 5,692,995 | A | 12/1997 | Alvarez et al. | |
| 5,749,811 | A | 5/1998 | Wilson | |
| 5,759,139 | A * | 6/1998 | Wright | A63B 21/4047 482/121 |
| 5,911,650 | A | 6/1999 | Cox | |
| 6,231,484 | B1 | 5/2001 | Gordon | |
| 6,955,634 | B1 | 10/2005 | Lat | |
| 6,991,589 | B1 | 1/2006 | Patterson | |
| 7,014,595 | B2 | 3/2006 | Bruno | |
| 7,232,404 | B2 | 6/2007 | Nelson | |
| 7,364,531 | B2 | 4/2008 | Chu | |

* cited by examiner

EXERCISE APPARATUS

FIELD OF THE INVENTION

The present invention relates to exercise equipment.

BACKGROUND OF THE INVENTION

Calisthenics and weightlifting are both forms of strength training useful for developing stronger muscles. Calisthenics exercises do not rely on equipment or devices, instead relying on one's own body weight for resistance. Weightlifting normally involves the use of free weights and specialized weight-training machines.

A primary advantage of calisthenics over weightlifting is the flexibility and ease of practicing in any place, at any time. All that is needed is a clear space to practice powerful moves like pushups, situps, crunches, climbers, and lunges. A chin-up bar can be used for pull ups. A stool can be used for step-ups. Calisthenics are typically not useful for developing muscle mass. While some moves can be modified to increase resistance, resistance is limited by the individual's body weight. Also, to focus on specific muscles, weight-training machines typically offer a better means of isolation. For beginners, calisthenics can pose a steeper learning curve because correct posture is important to successfully completing the movements.

Lifting weights is the best method for strengthening muscles. The resistance offered by weights can be increased or decreased as necessary to train specific muscles at the correct levels. However, lifting weights incorrectly or with poor posture can result in injury and ineffective results. Beginners should seek qualified instruction to achieve proper form and learn safe practices.

In order to achieve optimum fitness, many fitness professionals recommend a combination of calisthenics and weightlifting. Although there are various examples in the prior art of exercise equipment that attempt to be useful in calisthenics exercises and resistance training exercises, there is a need in the art for an exercise apparatus that is useful for strengthening overall body strength, particularly the arm muscles, core muscles, and leg muscles, that is useful for developing balance, that is easy to construct and safe to use, and that exploits leverage and imbalance to assist a user in vary resistance during use for strength training purposes.

SUMMARY OF THE INVENTION

According to the principle of the invention, an exercise apparatus includes a base having a rear end and a front end. A support extends upright from the front end of the base and supports a handle assembly disposed at an elevated location relative to the front end of the base. There is a framework between the rear end of the base and the front end of the base. The framework is mounted to the rear end of the base for movement of the framework between a lowered inclined position relative to the rear end of the base and a raised inclined position relative to the rear end of the base. First and second foot supports are each mounted to the framework for movement in reciprocal directions relative to the handle assembly. The exercise apparatus further includes a framework locking assembly for selectively retaining the framework in the lowered inclined position and the raised inclined position. The support is adjustable between a shortened condition and a lengthened condition for height adjustment of the handle assembly. The exercise apparatus further includes a support locking assembly for selectively retaining the support in the shortened condition and the lengthened condition. The support is mounted to the front end of the base with a pedestal assembly that permits the support to sway and rotate. The pedestal assembly includes an elastomeric body coupled between the support and a fixture mounted to the front end of the base. The base is adjustable between a shortened condition for moving the framework toward the handle assembly, and a lengthened condition for moving the framework away from the handle assembly. The exercise apparatus further includes a base locking assembly for selectively retaining the base in the shortened condition and the lengthened condition.

According to the principle of the invention, an exercise apparatus includes a base having a rear end and a front end. A support extends upright from the front end of the base and supports a handle assembly disposed at an elevated location relative to the front end of the base. There is a framework between the rear end of the base and the front end of the base. The framework is mounted to the rear end of the base for side-to-side pivotal movement of the framework about a longitudinal axis. First and second foot supports are each mounted to the framework on either side of the longitudinal axis for movement in reciprocal directions relative to the handle assembly. A bias is applied to the framework, which tends to urge the framework toward the normal position. The support is adjustable between a shortened condition and a lengthened condition for height adjustment of the handle assembly. The exercise apparatus includes a support locking assembly for selectively retaining the support in the shortened condition and the lengthened condition. The support is mounted to the front end of the base with a pedestal assembly that permits the support to sway and rotate. The pedestal assembly includes an elastomeric body coupled between the support and a fixture mounted to the front end of the base. The base is adjustable between a shortened condition for moving the framework toward the handle assembly, and a lengthened condition for moving the framework away from the handle assembly. The exercise apparatus further includes a base locking assembly for selectively retaining the base in the shortened condition and the lengthened condition.

According to the principle of the invention, an exercise apparatus includes a base having a rear end and a front end. A support extends upright from the front end of the base and supports a handle assembly disposed at an elevated location relative to the front end of the base. There is a framework between the rear end of the base and the front end of the base. The framework is mounted to the rear end of the base for movement of the framework between a lowered inclined position relative to the rear end of the base and a raised inclined position relative to the rear end of the base, and for side-to-side pivotal movement of the framework about a longitudinal axis. First and second foot supports are each mounted to the framework on either side of the longitudinal axis for movement in reciprocal directions relative to the handle assembly. A bias is applied to the framework, which tends to urge the framework toward the normal position. The exercise apparatus further includes a framework locking assembly for selectively retaining the framework in the lowered inclined position and the raised inclined position. The support is adjustable between a shortened condition and a lengthened condition. The exercise apparatus further includes a support locking assembly for selectively retaining the support in the shortened condition and the lengthened condition. The support is mounted to the front end of the base with a pedestal assembly that permits the support to sway and rotate. The pedestal assembly includes an elastomeric body coupled between the support and a fixture mounted to the front end of the base. The exercise apparatus according to claim 16, wherein the base is adjustable between a shortened condition for moving the framework toward the handle assembly, and a lengthened condition for moving the framework away from the handle assembly. The exercise apparatus further includes a base locking assembly for selectively retaining the base in the shortened condition and the lengthened condition.

Consistent with the foregoing summary of preferred embodiments, and the ensuing detailed description, which are to be taken together, the invention also contemplates associated apparatus and method embodiments.

BRIEF DESCRIPTION OF THE DRAWINGS

Referring to the drawings.

DETAILED DESCRIPTION

Figure 1:
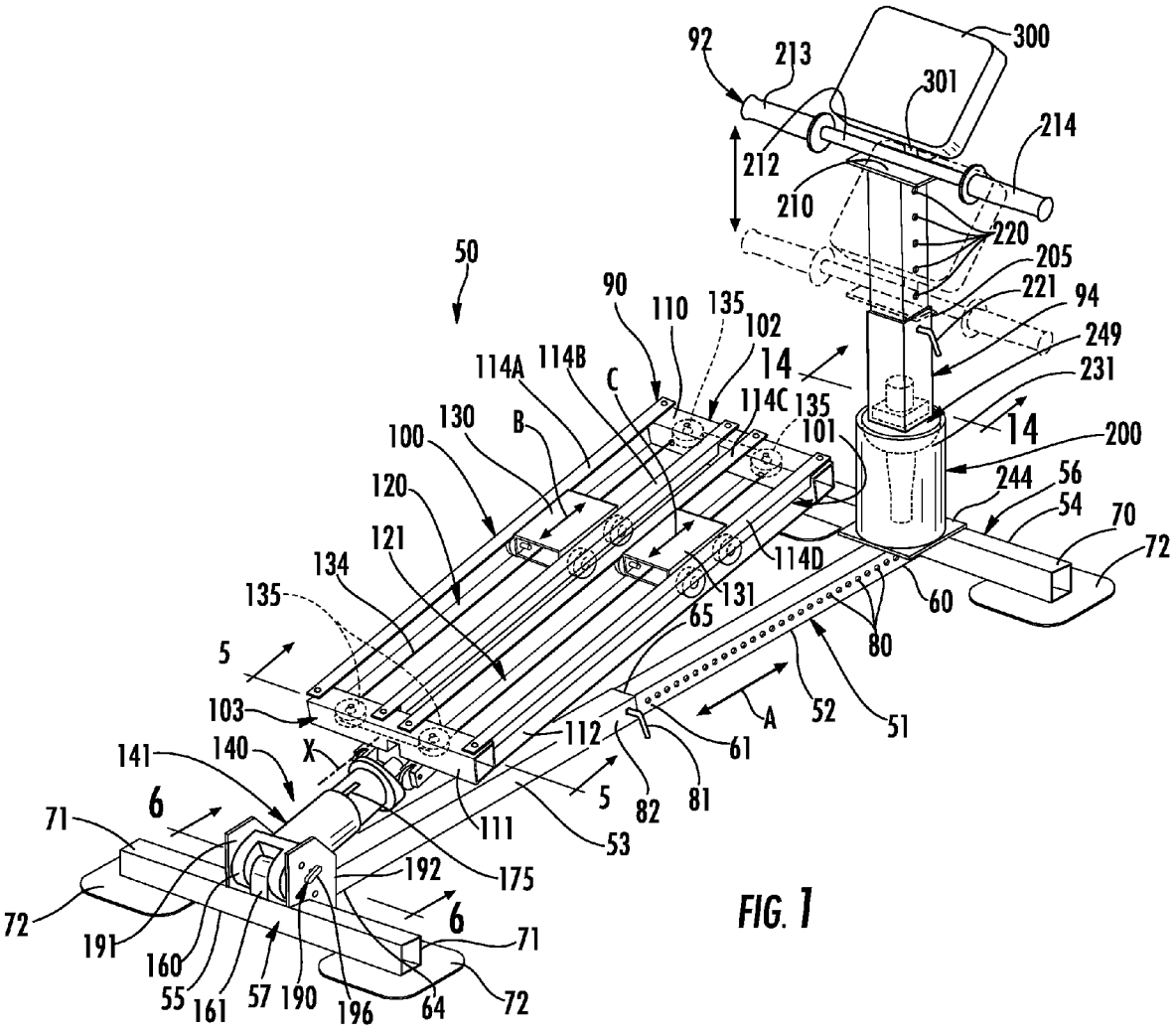
FIG. 1 is a rear perspective view of an exercise apparatus constructed and arranged in accordance with the principle of the invention, the exercise apparatus includes a base having a front end and a rear end, a support that supports a handle assembly at an elevated location relative to a front end of a base, a framework, between a rear end of the base and the front end of the base, mounted to the rear end of the base with a coupling assembly, and foot supports each mounted to the framework for movement in reciprocal directions relative to the handle assembly, the view being partly schematically shown to illustrate raised and lowered positions of the handle assembly.

Turning now to the drawings, in which like reference characters indicate corresponding elements throughout the several views, attention is first directed to FIG. 1 in which there is seen an exercise apparatus 50 including a base 51, fashioned of metal, such as steel or aluminum, or other equivalent strong durable material, having a front longitudinal member 52 and a rear longitudinal member 53 between a front transverse member 54 at a front end 56 of base 51 and a rear transverse member 55 at a rear end 57 of base 51. In this example, front and rear longitudinal members 52 and 53 and front and rear transverse members 54 and 55 are square metal tubes. Front longitudinal member 51 includes outer end 60 and inner end 61. Rear longitudinal member 53 includes outer end 64 and inner end 65. Outer end 60 of front longitudinal member 52 is rigidly affixed via welding to the middle of transverse front member 54, and outer end 64 of rear longitudinal member 53 is rigidly affixed via welding to the middle of rear transverse member 55.

Transverse front and rear members 54 and 55 are identical in size and shape, are parallel relative to each other, are axially aligned, and are perpendicular relative to front and rear longitudinal members 52 and 53. Transverse front member 54 extends laterally outwardly from either side of its attachment point to outer end 60 of front longitudinal member 52 to opposed free ends 70. Free ends 70 are equidistant from the connection of outer end 60 of front longitudinal member 52 to the middle of front transverse member 54. Transverse rear member 55 extends laterally outwardly from either side of its attachment point to outer end 64 of rear longitudinal member 53 to opposed free ends 71. Free ends 71 are equidistant from the connection of outer end 64 of rear longitudinal member 53 to the middle of rear transverse member 55. A plate 72 for engagement with the ground is affixed via welding to the underside of each free end 70 of transverse front member 54 and each free end 71 of transverse rear member 55.

Figure 2:
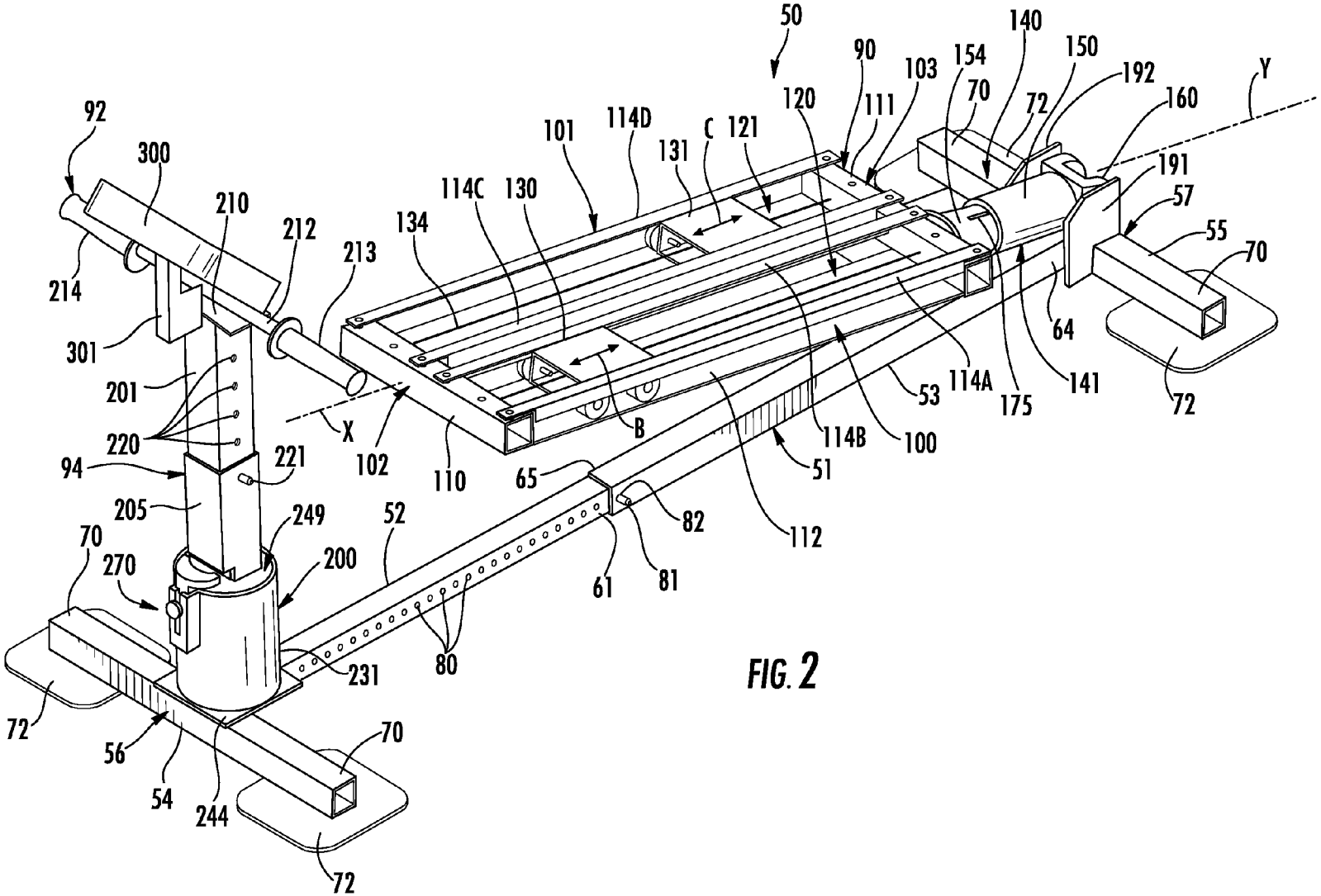
FIG. 2 is a front perspective view of the embodiment of FIG. 1.
Figure 3:
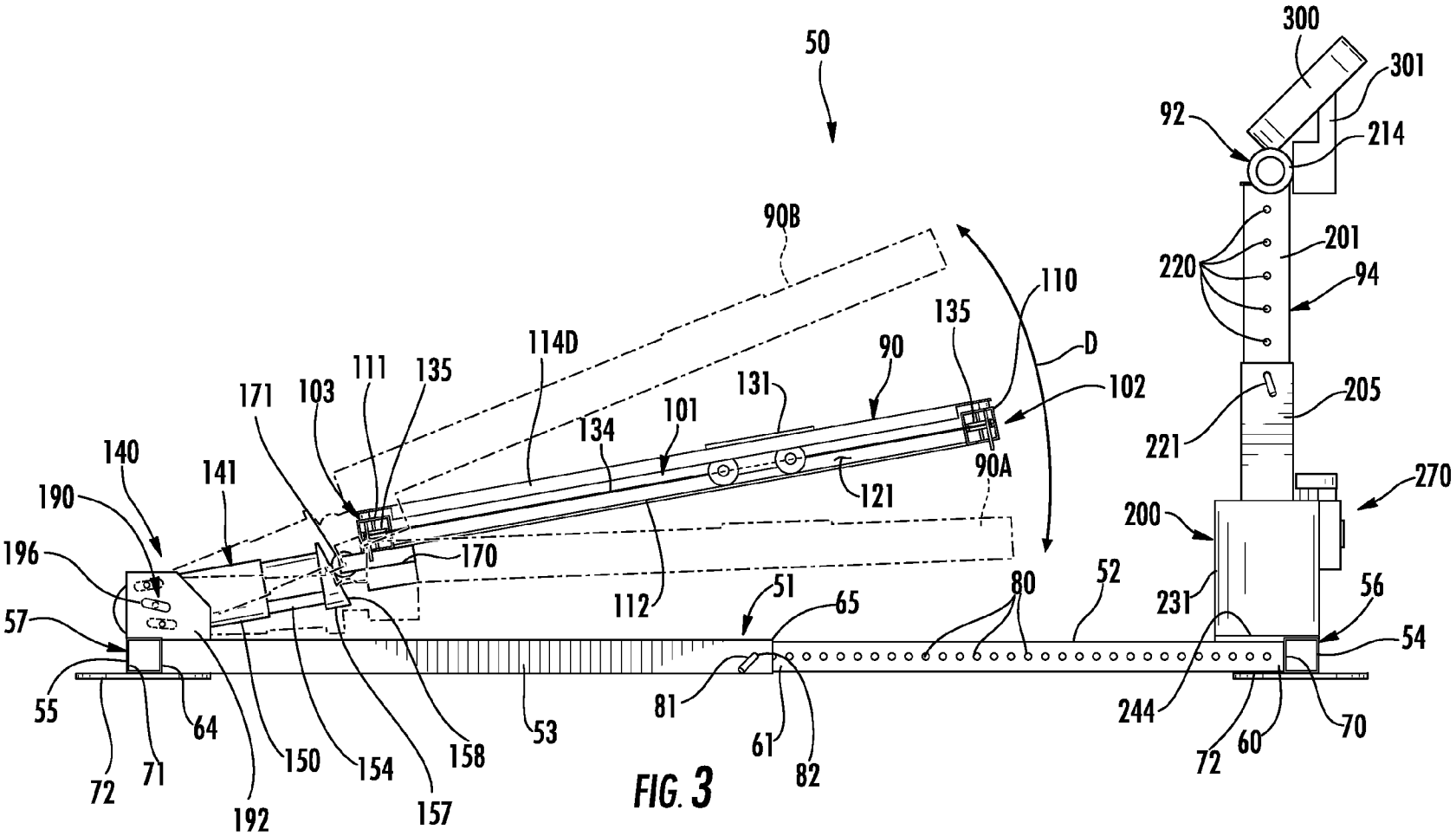
FIG. 3 is a side elevation view of the embodiment of FIG. 1, the view being partly schematically shown to illustrate a lowered inclined position of the framework, a raised inclined position of the framework, and an intermediate inclined position of the framework between the lowered and raised inclined positions of the framework.
Figure 4:
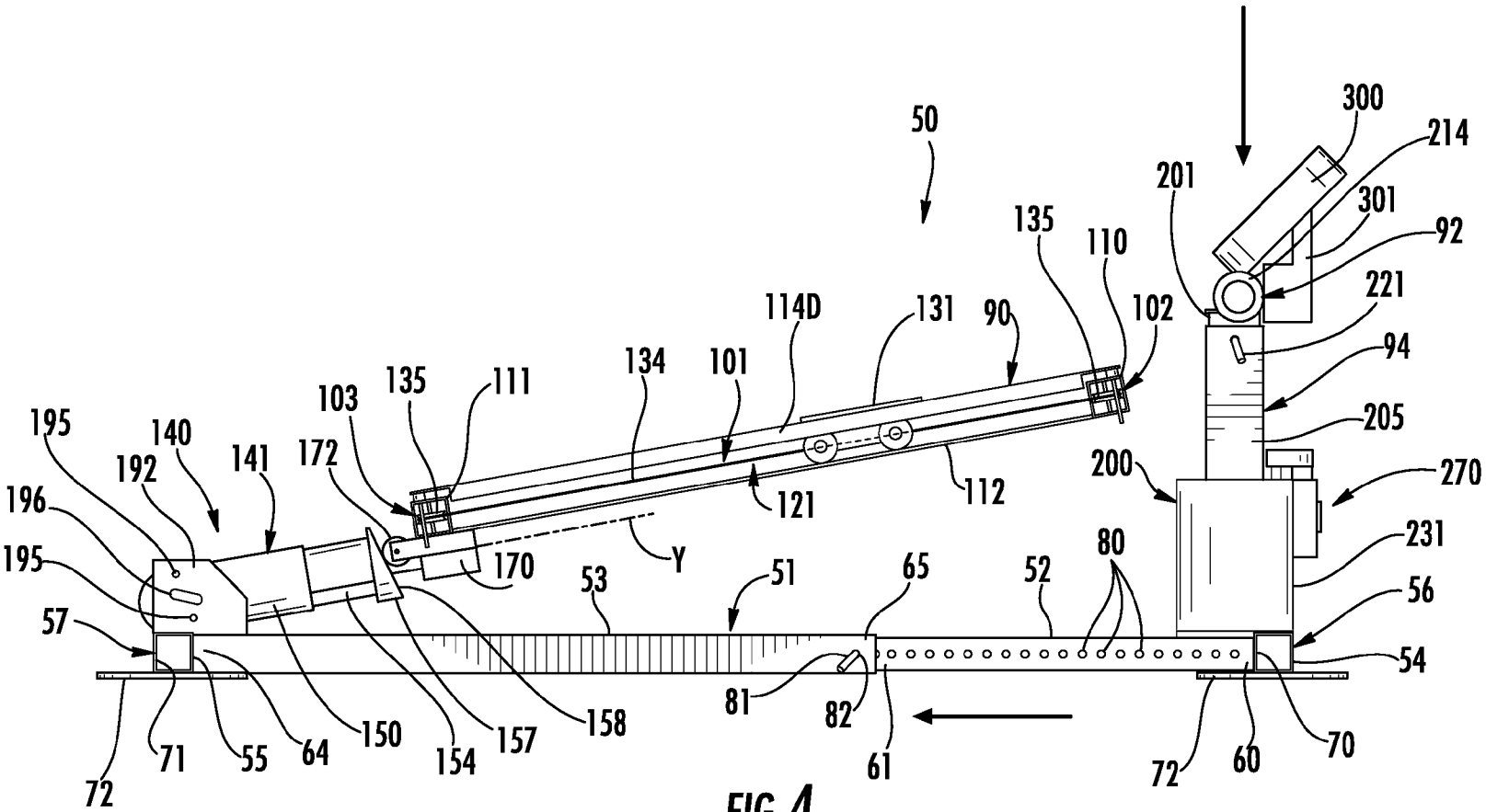
FIG. 4 is a view corresponding to FIG. 3 illustrating the base as it would appear adjusted to a shortened condition.

Front and rear longitudinal members 52 and 53 are coaxial and are between front transverse member 54 and rear transverse member 55. Front longitudinal member 52 extends inwardly in a direction toward rear transverse member 55 from outer end 60 to inner end 61, and rear longitudinal member 53 extends inwardly in a direction toward front transverse member 54 from outer end 64 to inner end 65. Inner end 61 of front longitudinal member 52 is received in rear longitudinal member 53 through outer end 64 for telescoping motion of front longitudinal member 52 into and out of rear longitudinal member 53 indicated by double arrowed line A in FIG. 1 for facilitating length adjustment of the overall length of base 51 from front end 56 of base 51 to rear end 57 of base 51 from a lengthened condition base 51, such as shown in FIGS. 1-3, and a shortened condition of base 51, such as shown in FIG. 4. Front longitudinal member 52 and rear longitudinal member 53 are coupled together in telescoping engagement. Front and rear ends 56 and 57 of base 51 are farther apart in the lengthened condition of base 51 in FIGS. 1-3 for setting exercise apparatus 50 to accommodate a tall user compared to in the shortened condition of base 51 in FIG. 1 for setting exercise apparatus to accommodate a shorter user. The ability to adjust the overall length of base 51 from front end 56 to rear end 57 allows exercise apparatus 50 to be adjusted to fit users of varying height.

Exercise apparatus 50 includes a base locking assembly for selectively locking front longitudinal member 52 to rear longitudinal member for selectively retaining base 51 in the lengthened condition in FIGS. 1-3, the shortened condition in FIG. 4, and in selected positions between the lengthened condition and the shortened condition, all for the purpose of allowing the overall length base 51 to be selectively adjusted to coincide with the height of the user in the safe and efficient use of exercise apparatus 50. The base locking assembly is an adjustable locking pin assembly including equally spaced apart pairs of aligned holes 80 along the length of front longitudinal member 52 from outer end 60 to inner end 61, and a pin 81, which is concurrently applied through a pair of aligned holes 82 formed in inner end 65 of rear longitudinal member 53 and a selected pair of aligned holes 80 in front longitudinal member 52 in each of the shortened and lengthened condition of base 51 pinning front longitudinal member 52 to rear longitudinal member 53. The overall length of base 51 from front end 56 to rear end 57 can be set to various locations between the lengthened and shortened condition of base 51 corresponding to the spacing between the pairs of aligned holes 80 via the telescoping adjustment of front longitudinal member 52 relative to rear telescoping member 53, which allows exercise apparatus to be adjusted to fit the varying height of different users. Again, to lock front longitudinal member 52 to rear longitudinal member 53, front longitudinal member 52 is slid inwardly or outwardly to set base 51 to a selected length and aligning holes 82 in inner end 65 of rear longitudinal member 53 with a selected pair of aligned holes 80 in front longitudinal member 52, and pin 81 is concurrently applied through the aligned holes to pin front longitudinal member 52 to rear longitudinal member. To adjust the overall length of base 51 when set to a preselected length with the base locking assembly, one need only remove pin 81 by hand, telescopingly adjust front longitudinal member 52 relative to rear longitudinal member 52 to a preselected overall length of base 51 aligning the pair of aligned holes 82 in inner end 65 of rear longitudinal member 53 with a preselected pair of aligned holes 80 in front longitudinal member 52, and then concurrently apply pin 81 therethrough the aligned holes to pin front longitudinal member 52 to rear longitudinal member.

Base 51 is set plates 72 down on a supporting surface. The four-point contact footprint of plates 72 against the ground provides base 51 as stable platform for the additional components of exercise apparatus 50, including framework 90, between rear end 57 of base 51 and front end 56 of base 51, mounted to rear end 57 of base 51, and support 94 that extends upright from front end 56 of base 51 to a handle assembly 92 supported by upright support 94 at an elevated location relative to front end 56 of base 51. Framework 90 is mounted to rear end 57 of base 51 for movement of framework 90 between a lowered inclined position relative to rear end 57 of base 51 and a raised inclined position relative to rear end 57 of base 51. Left and right foot supports 130 and 131, each for receiving a foot of a user thereon, are each mounted to framework 90 for movement in reciprocal directions relative to handle assembly 92. Framework 90 is further mounted to rear end 57 of base 51 for side-to-side pivotal movement of framework 90 relative to a normal position of the framework 90 about a longitudinal axis Y in FIGS. 4, 8, 9-12, and 20, and left and right foot supports 130 and 131 are each mounted to framework 90 on either side of longitudinal axis Y for movement in reciprocal directions relative to handle assembly 92 and relative to front and rear ends 56 and 57 of base 51.

In FIGS. 1 and 2, framework 90 is fashioned of metal, such as steel or aluminum, or other equivalent strong durable material, and is rectangular in overall shape and includes opposed parallel sides 100 and 101 that extend between opposed parallel front and rear ends 103 and 104. Side 100 is the left side of framework 90, and side 101 is the right side of framework 90. Sides 100 and 101 are equal in length and front and rear ends 102 and 103 are equal in length. The length of each one of sides 100 and 101 is greater than the length of each of front and rear ends 102 and 103, characterizing the overall rectangular shape of framework 90.

Front and rear ends 102 and 103 of framework 90 are defined by opposed, parallel, front and rear transverse members 110 and 111, respectively, which are square tubes of equal size and shape. The underside of front and rear transverse members 110 and 111 are rigidly affixed, by welding, nut-and-bolt assemblies, or the like, to either end of a plate or floor 112, which is wide, flat, and rectangular in shape. Four spaced-apart, parallel metal stays 114, including, from left to right, left outermost stay 114A at side 100, left intermediate stay 114B between sides 100 and 101, right intermediate stay 114C between sides 100 and 101, and right outermost stay 114D at side 101, rigidly connect the top side of front transverse member 110 to the top side of rear transverse member 111. Stays 114A-114D are perpendicular relative to front and back transverse members 110 and 111, are parallel to and spaced above floor 112, extend over floor 112 from front transverse member 110 to rear transverse member 111, and are rigidly connected to the top sides of front and back transverse members 110 and 111, respectively, with nut-and-bolt assemblies, and welding, rivets, or other equivalent mechanical fastening can be used in alternate embodiments.

The left outermost stay 114A and the adjacent left intermediate stay 114B and the length of the top surface of floor 112 underlying and between left outermost and intermediate stays 114A and 114B define a left side track 120, and the right outermost stay 114D and the adjacent right intermediate stay 114C and the length of the top surface of floor 112 underlying and between right outermost and intermediate stays 114D and 114C define a right side track 121. Left and right side tracks 120 and 121 are parallel relative to each other, are transverse relative to front and rear ends 102 and 103 of framework 90, are parallel relative to sides 100 and 101 of framework 90, and extend along the length of framework 90 from front transverse member 110 at front end 102 of framework 90 to rear transverse member 111 at rear end 103 of framework 90.

Left foot support 130 and right foot support 131 are each a wheeled trolley. Left foot support 130 is situated in left side track 120 upon floor 112 between left outermost and intermediate stays 114A and 114B, respectively, and right foot support is situated in right side track 121 upon floor 112 between right outermost and intermediate stays 114D and 114C, respectively. Left and right supports 130 and 131 engage the top surface of floor 112 for wheeled movement over the top surface of floor 112. Left outermost and intermediate stays 114A and 114B constrain left support 130 in left side track 120 for wheeled movement over floor 112 along a left-side stroke path along the length of left side track 120 in reciprocal directions indicated by double arrowed line B relative to front and rear ends 102 and 103 of framework 90. Right outermost and intermediate stays 114D and 114C constrain right support 131 in right side track 121 for wheeled movement over floor 112 along a right-side stroke path along the length of right side track 121 in reciprocal directions indicated by double arrowed line C relative to front and rear ends 102 and 103 of framework 90.

Figure 5:
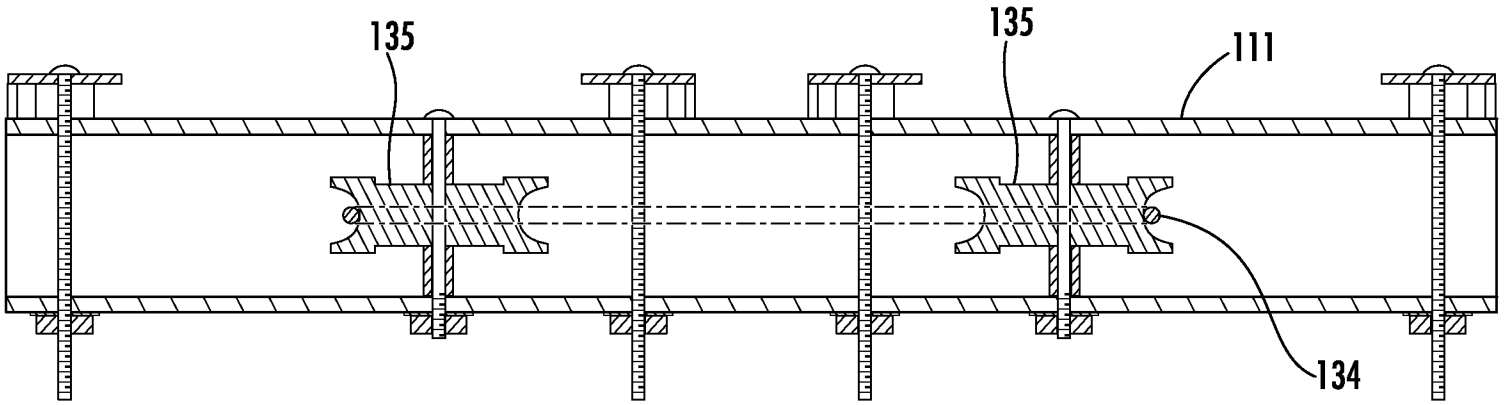
FIG. 5 is a section view taken along line 5-5 of FIG. 1.

Because the left and right side tracks 120 and 121 are parallel relative to each other, the left and right side stroke paths followed by left and right side foot supports 130 and 131, respectively, are parallel relative to each other. Left and right supports 130 and 131 are rigidly connected via welding, rivets, or staples, to a cable 134 entrained about pulleys 135 at both ends of left side track 120 and both ends of right side track 121. Cable 134 extends centrally through left and right side tracks 120 and 121, extends from left and right side tracks 120 and 121 through openings through front and rear transverse members 110 and 111, and extends through front and rear transverse members 110 and 111. The lengths of cable 134 in left and right side tracks 120 and 121 are parallel relative to each other, and the lengths of cable in front and rear transverse members 110 and 111 are parallel relative to each other and perpendicular relative to the lengths of cable 134 in left and right side tracks 120 and 121. Pulleys 135 at the forward ends of left and right side tracks 120 and 121, respectively, at front end 102 of framework 90 are each mounted for rotation within front transverse member 110, and pulleys 135 at the rearward ends of left and right side tracks 120 and 121, respectively, at rear end 103 of framework 90 are each mounted for rotation within rear transverse member 111. FIG. 5 is a section view taken along line 5-5 of FIG. 1 illustrating pulleys 135 mounted for rotation within rear transverse member 111. Front transverse member 111 has the identical arrangement.

Cable 134 operatively connects left and right supports 130 and 131, wherein movement of left support 130 in a forward direction from rear end 103 to front end 102 of framework 90 imparts corresponding movement of the right support 131 in the opposite rearward direction from front end 102 to rear end 103 of framework 90, and movement of left support 130 in a rearward direction from front end 102 to rear end 103 of framework 90 imparts corresponding movement of the right support 131 in the opposite forward direction from front end 102 to rear end 103 of framework 90. Likewise, movement of right support 131 in a forward direction from rear end 103 to front end 102 of framework 90 imparts corresponding movement of the left support 130 in the opposite rearward direction from front end 102 to rear end 103 of framework 90, and movement of right support 131 in a rearward direction from front end 102 to rear end 103 of framework 90 imparts corresponding movement of the left support 130 in the opposite forward direction from rear end 103 to front end 102 of framework 90. Left and right supports 130 and 131 are connected to opposite portions of cable 134, whereby left and right supports 130 and 131 move not only in reciprocal directions relative to front and rear ends 102 and 103 of framework 90, but also in opposite directions relative to one another as described. Left and right side tracks 120 and 121, and left and right side supports 130 and 131, reside on either side of a central longitudinal axis X of frame 90 from front end 93 to rear end 94.

Figure 11:
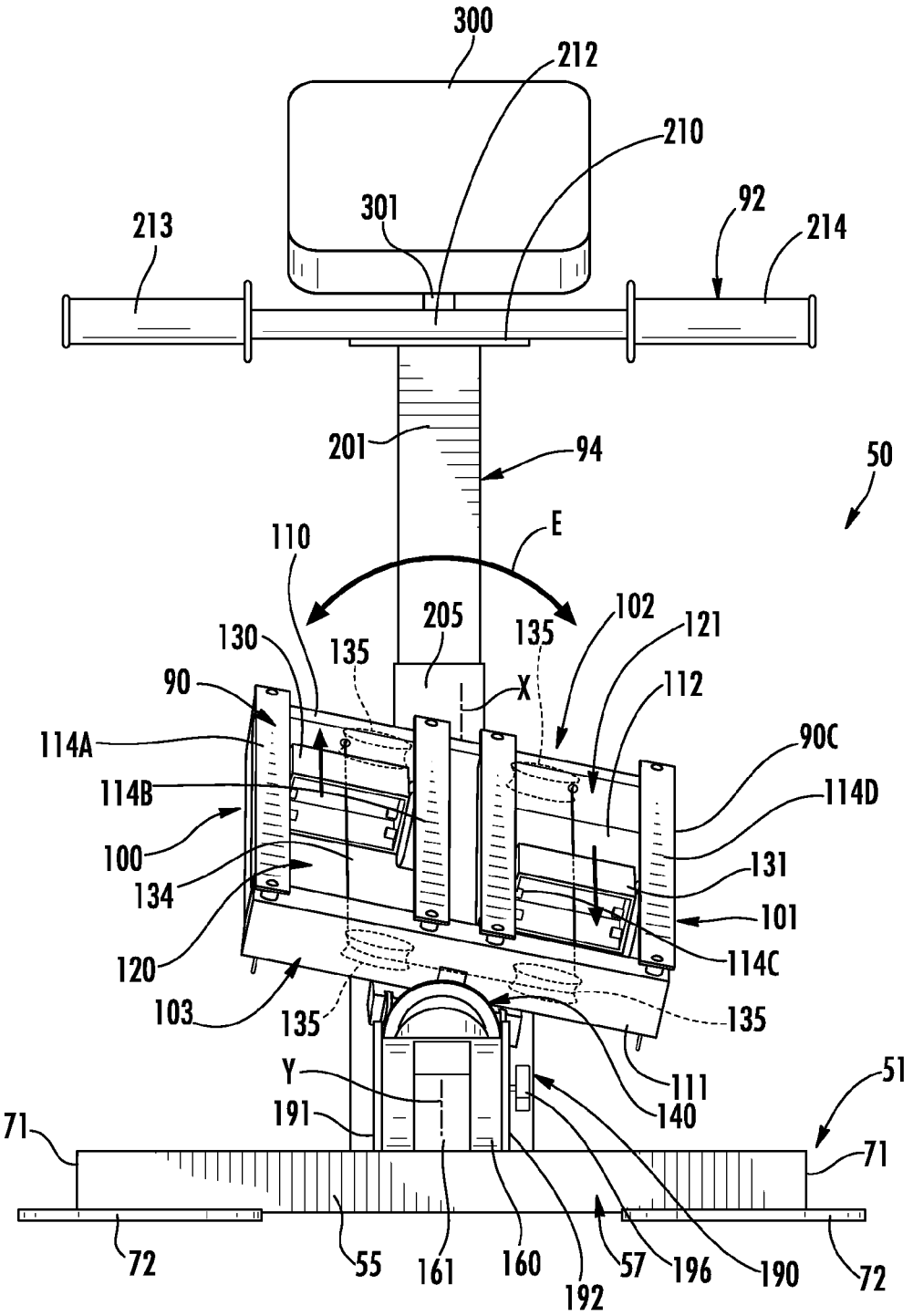
FIGS. 11 and 12 are rear end elevation views of the embodiment of FIG. 1 illustrating a side-to-side pivotal movement of the framework about a longitudinal axis.
Figure 12:
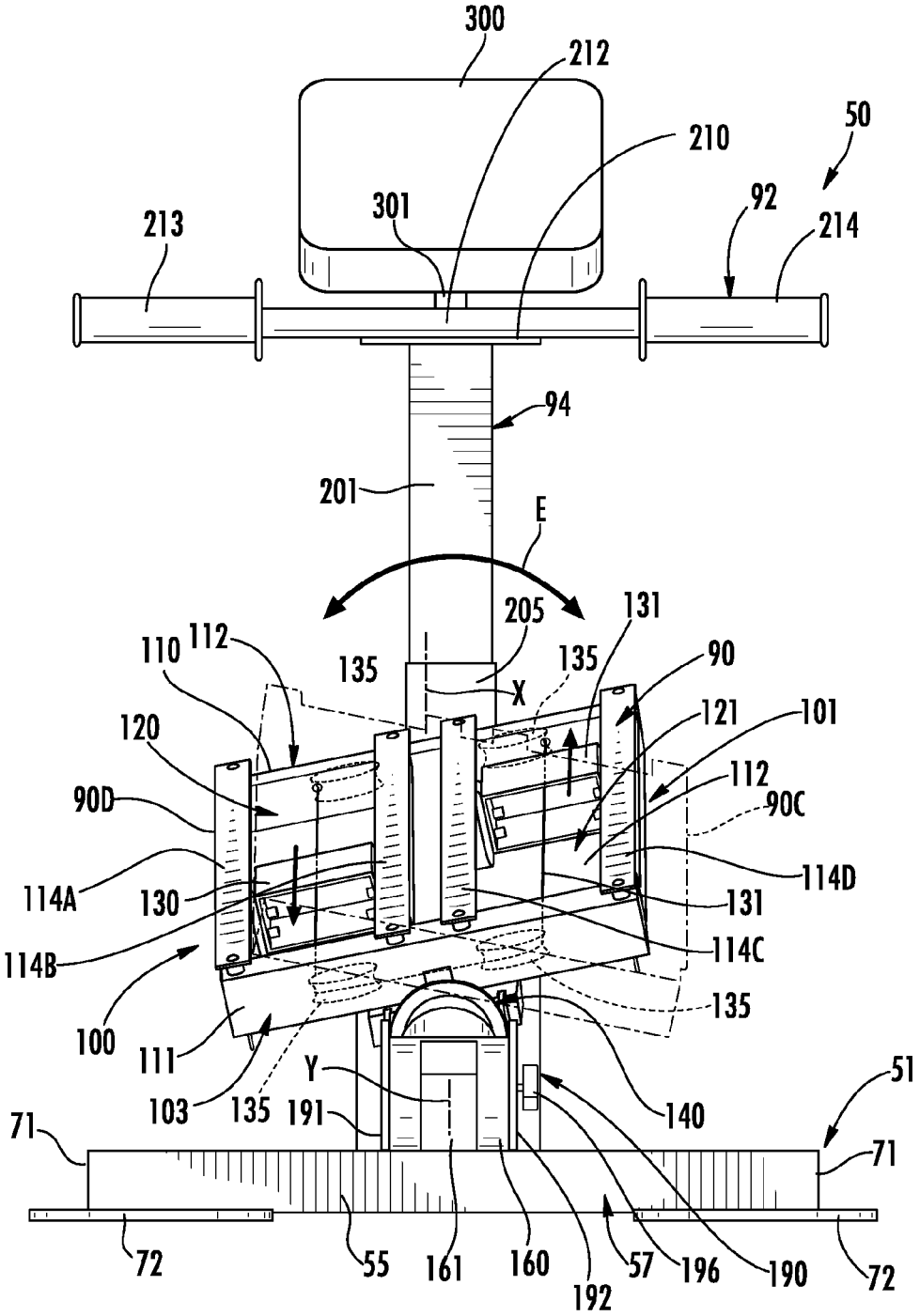

Framework 90 is located between front and rear ends 56 and 57 of base 51, and is mounted to rear end 57 of base 51 for movement of framework 90 in reciprocal directions indicated by double arrowed line D in FIG. 3 between a lowered inclined position relative to rear end 57 of base 51 indicated by dashed line position 90A and a raised inclined position relative to rear end 57 of base 51 indicated by dashed line position 90B in FIG. 3, and for side-to-side pivotal movement of the framework 90 indicated by double arrowed line E in FIGS. 11 and 12 about longitudinal axis Y from a right tilted position of framework 90 indicated by position 90C in FIG. 11 and by dashed line position 90C in FIG. 12 relative to a normal position of framework 90 in FIGS. 1 and 2, and a left tilted position of framework 90 indicated by position 90D in FIG. 12 relative to the normal position of framework 90 in FIGS. 1 and 2. A bias is applied to, or otherwise acts on, framework 90, tending to urge framework 90 toward the normal position of framework 90, which is considered the at-rest position of framework 90 between the left and right tilted positions of framework 90.

Figure 9:
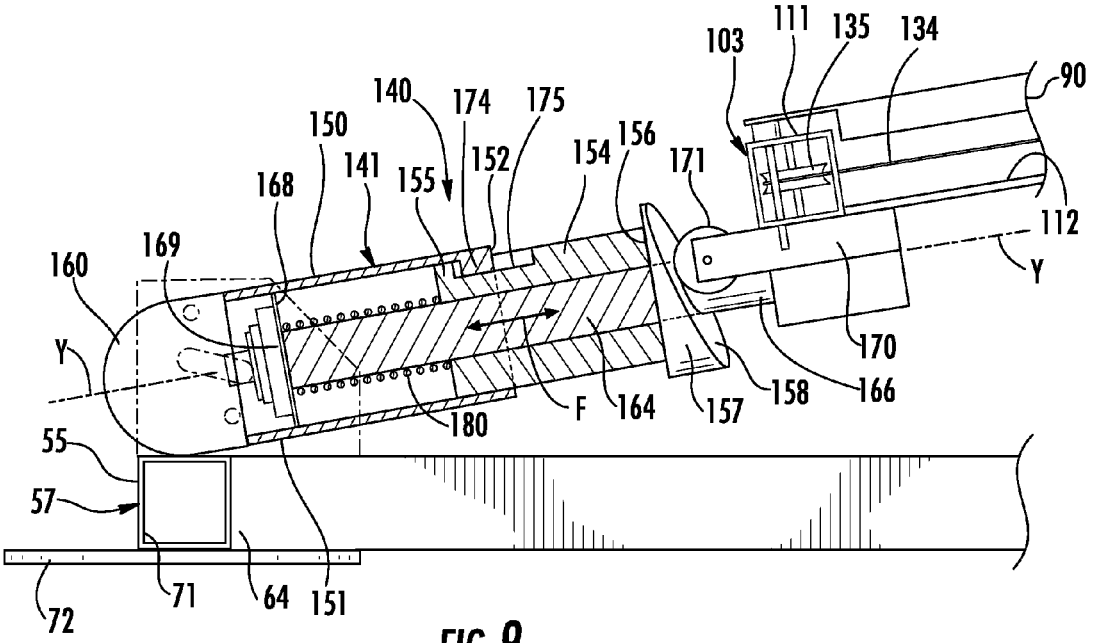
FIGS. 9 and 10 are enlarged fragmentary views of the coupling assembly corresponding to the illustration of FIG. 7, the views being partially sectioned to better illustrate the components thereof.
Figure 10:
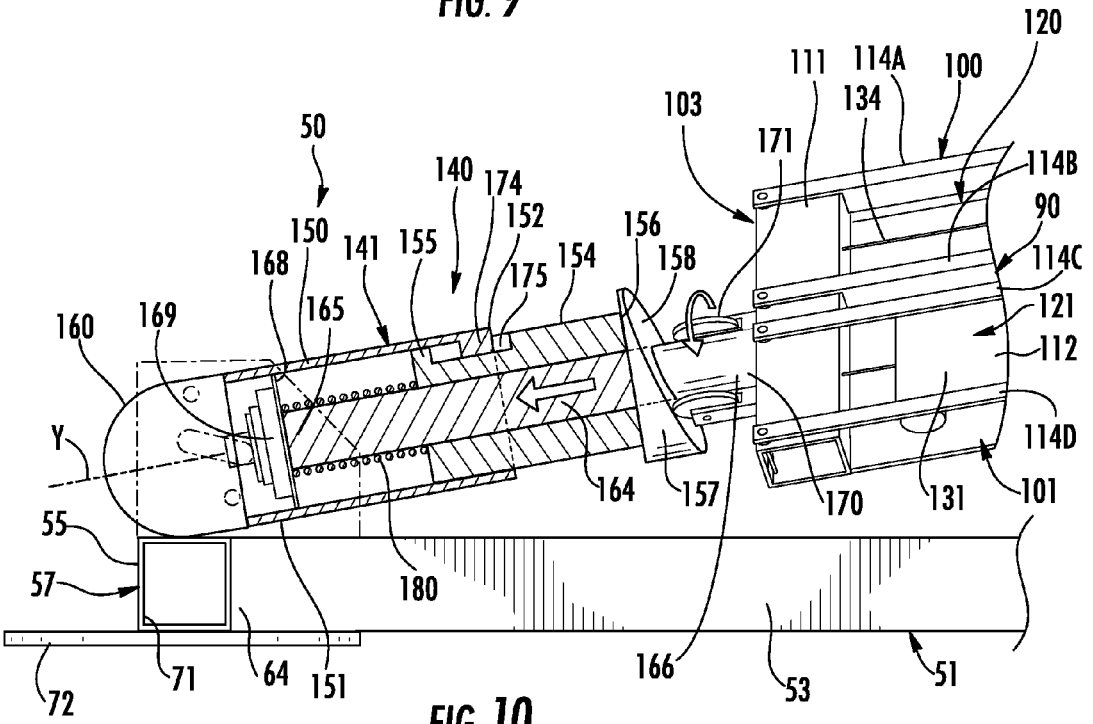

In FIGS. 1-4, framework 90 is mounted to rear end 57 of base 51 for movement from its raised and lowered positions and for side-to-side pivotal movement to either side of the at-rest or normal position of framework 90 with a coupling assembly 140 coupled between rear end 103 of framework 90 and rear end 57 of base 51. Coupling assembly 140 includes a cylinder assembly 141 coupled between rear end 103 of framework 90 and rear end 57 of base 51. In FIGS. 9 and 10, cylinder assembly 141 includes cylinder 150 having inner end 151 and outer end 152, and piston 154 having inner end 155 and outer end 156 formed with end cap 157 having outer cam surface 158 facing rear end 103 of framework 90. Cylinder 150 and piston 154 are coaxial being concurrently arranged about longitudinal axis Y. In FIG. 1, inner end 151 of cylinder 150 includes clevis 160 pivoted to eye bar 161, rigidly affixed via welding to the top side of rear transverse member 55 at a central location equidistant with respect to free ends 71 of rear transverse member 55 at intersection of outer end 64 of rear longitudinal member 53 and rear transverse member 55, with pivot pin 162 shown in FIG. 6. In FIGS. 9 and 10, inner end 155 of piston 154 is received in cylinder 150 through outer end 152 for telescoping motion of piston 154 in reciprocal directions indicated by double arrowed line F along axis Y between an extended position of piston 154 away from cylinder 150 in FIG. 9 and a retracted position toward cylinder 150 in FIG. 10. Piston 154 and cylinder 150 are coupled together in telescoping engagement.

Cam surface 158 is flat and is tilted at an oblique angle of from, for example, 15 to 25 degrees relative to axis Y. Cylinder 150 and piston 154 are arranged about a central rod 164 having an inner end 165 journaled to an interior end plate 168 within cylinder 150 with a bearing 169. Rod 164 extends from inner end 165 through cylinder 150 and through piston 154 through outer end 156 and cap 157 to an outer end 166 rigidly affixed to block 170 rigidly affixed centrally to the underside of transverse member 111 of framework 90 at rear end 103 of framework 90 with nut-and-bolt assemblies, although welding and or other equivalent mechanical fasteners can be used. Outer end 166 is rigidly affixed to block 170 via welding or press-fitting of outer end 166 within a socket formed in block 170. In another embodiment, block 170 can be integrally formed with outer end 166 of rod 164. Rod 164 is free to rotate at the journaled coupling of inner end 165 within cylinder 150 about longitudinal axis Y relative to and within cylinder 150 and piston 154. Framework 90 extends forwardly toward front end 102 and handle assembly 92 from rear end 103 affixed to block 170 of coupling assembly 140 to front end 102. With this orientation of framework 90, left and right supports 130 and 131 are mounted to reciprocal along left and right side tracks 120 and 121, respectively, along either side of longitudinal axis X of framework 90 and longitudinal axis Y of coupling assembly 140 for movement in reciprocal directions relative to handle assembly 92 from front end 102 of framework 90 to rear end 103 of framework 90. Block 170 carries a pair of bearings 171, here in the form of rollers, in contact with bearing surface 158. Cylinder 150 has a key 174 that rides in a corresponding longitudinal groove 175 in piston 154 which, while allowing piston 154 to reciprocate relative to cylinder 150 as indicated by double arrowed line F, prevents piston 154 from rotating relative to rod 164 and cylinder 150 about axis Y. The interaction between key 174 and groove 175 is an anti-rotation assembly that prevents relative rotation between cylinder 150 and piston 154. A compression spring 180 is disposed in cylinder 150. Compression spring 180 encircles rod 164, is captured between end plate 168 proximate to end 151 of cylinder 150 and inner end 155 of piston 154, and constantly acts against end plate 168 and inner end 155 of piston 154 so as to constantly bias or otherwise urge piston 154 toward its extended position away from cylinder 150 for, in turn, constantly urging cam surface 158 against bearings 171.

The pivotal attachment of clevis 160 to eye bar 161 with pivot pin 162 provides pivotal movement of framework 90 between its lowered inclined position relative to rear end 57 of base 51 indicated by dashed line position 90A in FIG. 3 and its raised inclined position relative to rear end 57 of base 51 indicated by dashed line position 90B in FIG. 3. The journaled coupling of rod 164 to inner end 151 of cylinder 150 allows framework 90 and rod 164 to concurrently rotate/pivot about longitudinal axis Y for side-to-side pivotal movement of the framework 90 indicated by double arrowed line E in FIGS. 11 and 12 from and between its right tilted position indicated by position 90C in FIG. 11 and by dashed line position 90C in FIG. 12, and its left tilted position indicated by position 90D in FIG. 12. Left and right side tracks 120 and 121, and left and right side supports 130 and 131, reside on either side of not only longitudinal axis X of frame 90 from front end 93 to rear end 94, but also longitudinal axis Y about which rod 164 rotates for, in turn, producing the corresponding side-to-side pivotal movement of the framework 90 between its right tilted position indicated by position 90C in FIG. 11 and by dashed line position 90C in FIG. 12, and its left tilted position indicated by position 90D in FIG. 12.

As intimated above, a bias acts on, or is otherwise applied to, framework 90 tending to urge framework 90 toward or otherwise into its normal or at-rest position from each of the left and right tilted positions of framework 90. Coupling assembly 140 provides this bias. Specifically, compression spring 180 encircling rod 164 constantly acts on end plate 158 of cylinder 150 and inner end 155 of piston 154 constantly urging piston 154 toward its extended position toward rear end 103 of framework 90 away from cylinder 150 for, in turn, constantly urging cam surface 158 against bearings 171. In response to a force applied against framework 90 by a user in the use of exercise apparatus 50 tilting framework 90 about axis Y from the normal or at-rest position of framework 90 in FIG. 9 to the right tilted position of framework 90 in FIG. 10, the right side bearing 171 is driven downwardly against tilted cam surface 158 overcoming the bias supplied by compression spring 180 causing piston 154 to be driven inwardly from its extended position to its retracted position shown in FIG. 10. In response to removal of the force tilting framework 90 to its right tilted position, the bias supplied by compression 180 urges piston 154 from its retracted position in FIG. 10 to its extended position in FIG. 9 which, in turn, urges cam surface 158 forwardly against the right side bear 171, which is driven upwardly against tilted bearing surface 158 urging framework 90 from its right tilted position in FIG. 10 back to its normal or at-rest position in FIG. 9. Likewise, in response to a force applied against framework 90 by a user in the use of exercise apparatus 50 tilting framework 90 about axis Y from the normal or at-rest position of framework 90 to the left tilted position of framework 90, the left side bearing 171 is driven downwardly against tilted cam surface 158 overcoming the bias supplied by compression spring 180 causing piston 154 to be driven inwardly from its extended position to its retracted position. In response to removal of the force tilting framework 90 to its left tilted position, the bias supplied by compression 180 urges piston 154 from its retracted position to its extended position which, in turn, urges cam surface 158 forwardly against the left side bear 171, which is driven upwardly against tilted bearing surface 158 urging framework 90 from its left tilted position back to its normal or at-rest position.

Figure 6:
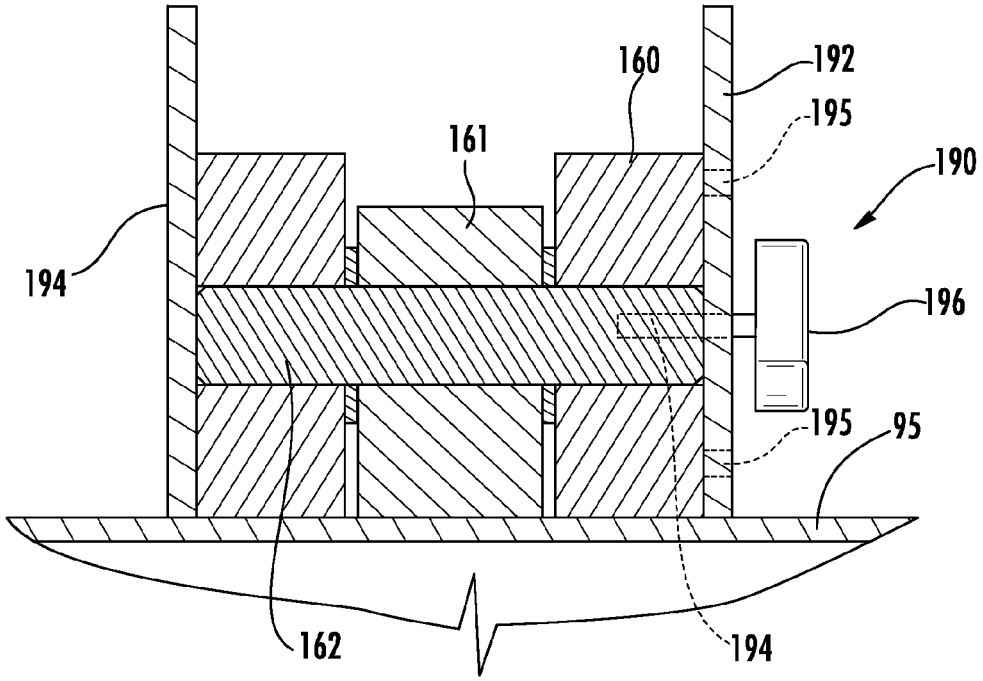
FIG. 6 is a section view taken along line 6-6 of FIG. 1.
Figure 7:
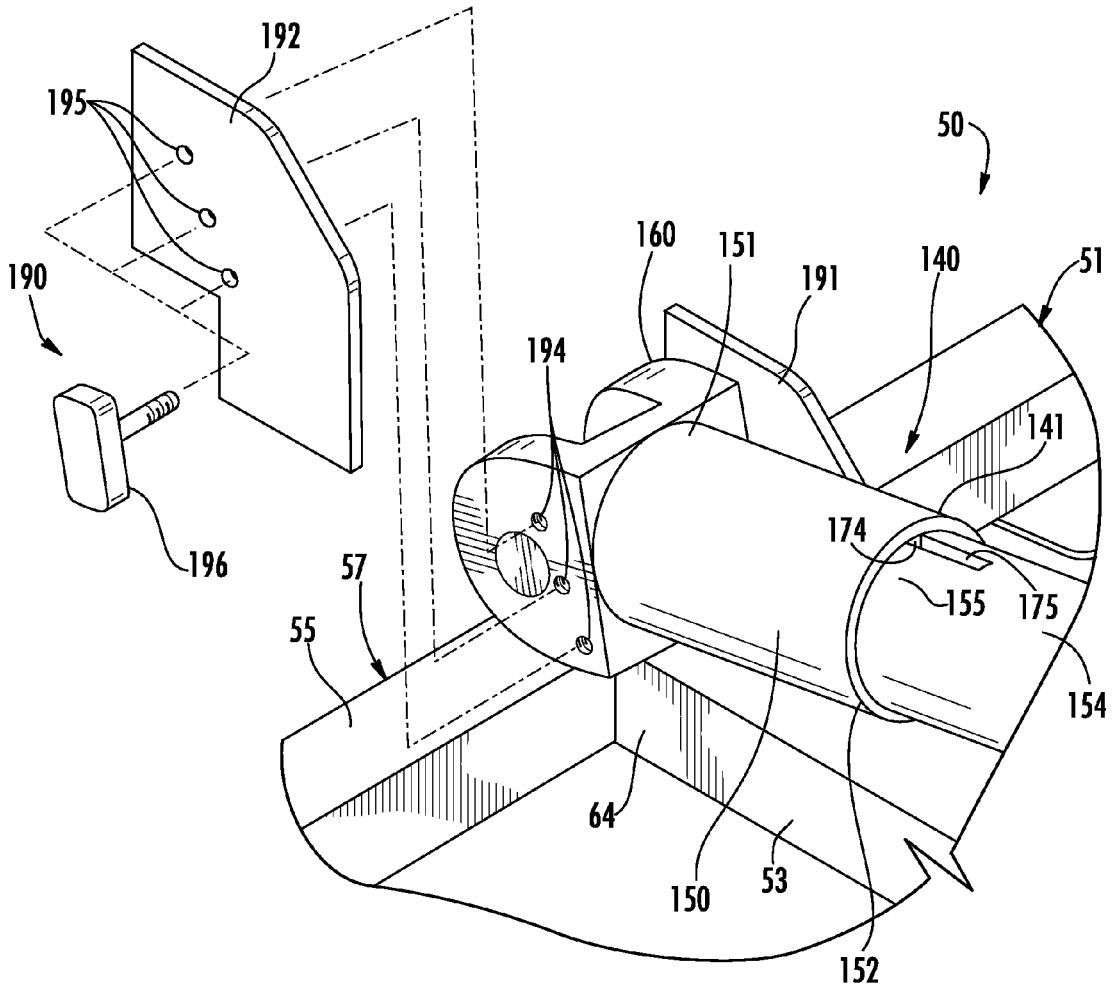
FIG. 7 is a partially exploded perspective view corresponding to FIG. 1 illustrating a locking assembly between the rear end of the base and the coupling assembly connecting the framework to the rear end of the base.
Figure 8:
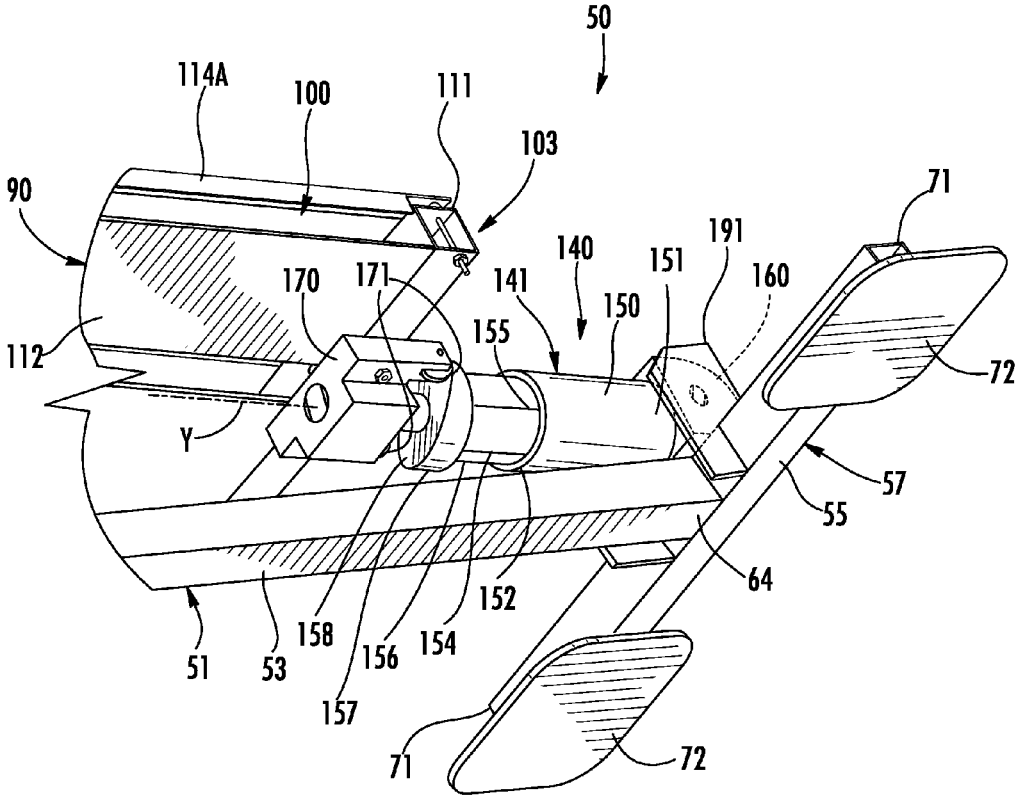
FIG. 8 is an enlarged fragmentary view corresponding to FIG. 1 illustrating the coupling assembly connecting the framework to the rear end of the base.

Exercise apparatus 50 is fashioned with a framework locking assembly 190 for selectively retaining framework 90 in the lowered inclined position indicated by dashed line position 90A in FIG. 3, its raised inclined position indicated by dashed line position 90B in FIG. 3, and at least one intermediate inclined position between the lowered inclined position and the raised inclined position as shown in FIGS. 1, 2, and 4 and as indicated by the solid line position of framework 90 in FIG. 3. In FIGS. 1 and 6, opposed, axially-aligned left and right brackets 191 and 192 are rigidly affixed to rear transverse support member 111 on either side of clevis 160. In FIG. 7, framework locking assembly 190 is an adjustable locking pin assembly that includes a series of holes 194 formed in the left side of clevis 160 that can be selectively aligned with corresponding holes 195 formed through left bracket 192 in response to pivoting framework 90 at the pivot point between clevis 160 and eye bar 161. To set framework 90 in its lowered inclined position, framework 90 is pivoted to its lowered inclined position and then locked in place by inserting handled pin 196 into one of the corresponding pairs of aligned holes 194 and 195. To set framework 90 in its raised inclined position, framework 90 is pivoted to its raised inclined position and then locked in place by inserting handled pin 196 into one of the corresponding pairs of aligned holes 194 and 195. To set framework 90 in its intermediate inclined position, framework 90 is pivoted to its intermediate inclined position and then locked in place by inserting handled pin 196 into one of the corresponding pairs of aligned holes 194 and 195. In the lowered inclined position, framework 90 is inclined upwardly 3 degrees relative to the horizontal from rear end 103 to front end 102. In the intermediate inclined position, framework 90 is inclined upwardly 15 degrees relative to the horizontal from rear end 103 to front end 102. In the raised inclined position, framework 90 is inclined upwardly 30 degrees relative to the horizontal from rear end 103 to front end 102. These different degrees of inclination of framework 90 are chosen as a matter of example. Other selected degrees of inclination can be selected for the lowered inclined position of framework 90, the intermediate inclined position of framework 90, and the raised inclined position of framework 90. Furthermore, although there is one described intermediate inclined position of framework 90 described herein, framework 90 can be set to other inclined positions between the raised inclined position and the lowered inclined position simply by pivoting framework 90 to a selected position between its raised inclined position and its lowered inclined position so as to align at least one hole 194 in clevis 160 and at least one hole 195 in left bracket 191, and then framework 90 can be locked in place at the selected position simply by inserting handled pin 196 into the aligned holes 194 and 195. The locking pin assembly embodiment of the framework locking assembly 190 is simple and efficient. Other forms of locking assemblies suitable for adjusting framework 90 between and locking framework 90 in its various inclined positions can be used, such as a ratchet assembly, a locking arm assembly, etc.

In FIGS. 1-4 and 13, support 94 extends upright from front end 56 of base 51 to a handle assembly 92 supported by upright support 94 at an elevated location relative to front end 56 of base 51. Support 94 is mounted to the front end of the base with a pedestal assembly 200 that permits support 94, and thus handle assembly 92 carried by support 94, to sway and to rotate. Support 94 is fashioned of metal such as steel or aluminum, or other strong durable material, and is an assembly consisting of elongate upper member 201 and elongate lower member 205. Upper and lower members 201 and 205 are square metal tubes. Upper member 201 includes upper and lower ends 202 and 203. Lower member 205 includes upper and lower ends 206 and 207. Lower end 207 of lower member 205 is connected to pedestal assembly 200, and extends upright therefrom to upper end 206. Lower end 203 of upper member 201 is received/nested in lower member 205 through upper end 206, and extends upright therefrom to upper end 201. A plate 210 is rigidly affixed atop upper end 202 of upper member 201 via welding. Handle assembly 92 includes elongate bar 212 rigidly affixed at its middle to the top side of plate 210 via welding, and extends laterally outward to a pair of fixed laterally extending left and right grips 213 and 214. Lower end 203 of upper member 201 is received/nested in lower member 205 through upper end 206 for telescoping motion of upper member 201 into and out of upper end 206 of lower member 205 indicated by double arrowed line G in FIG. 13 for facilitating length adjustment of the overall length of support 94 from lower end 207 of lower member 205 to plate 210 at upper end 202 of upper member 201 from a lengthened condition of support 94, such as shown in FIGS. 1-3 and 11-13, and a shortened condition of support 94, such as shown in FIG. 4, for height adjustment of handle assembly 92 relative to front end 56 of base 51 between a raised position of handle assembly 92 in FIGS. 1-3 and 11-13 corresponding to the lengthened condition of support 94 and a lowered position of handle assembly 92 in FIG. 4 corresponding to the shortened condition of support 94. This height adjustment of handle assembly 92 is useful for setting the height of handle assembly 92 to accommodate the user. The ability to adjust the height of handle assembly 92 allows exercise apparatus 50 to be adjusted to orient the user and to fit users of varying height.

Exercise apparatus 50 includes a support locking assembly for selectively locking upper support 201 to lower support 205 for selectively retaining support 94 in the lengthened condition in FIGS. 1-3 and 11-13 and the shortened condition in FIG. 4 and in selected positions between the lengthened condition and the shortened condition, all for the purpose of handle assembly 92 height adjustment. The support locking assembly includes an adjustable pin locking assembly that includes equally spaced apart pairs of aligned holes 220 along the length of upper member 201 from upper end 202 to lower end 203, and a pin 221, which is concurrently applied through a pair of aligned holes 222 formed in outer end 206 of lower member 205 and a selected pair of aligned holes 220 in upper member 201 in each of the shortened and lengthened condition of support 94 pinning upper member 201 to lower member 205. The overall length of support 94 from lower end 207 of lower support 205 to upper end 202 of upper support 201 can be set to various locations between the lengthened and shortened condition of support 94 corresponding to the spacing between the pairs of aligned holes 220 via the telescoping adjustment of upper member 201 relative to lower member 205, which allows the height of handle assembly 92 relative to front end 56 of base 51 to be adjusted to set exercise apparatus 50 to be adjusted to fit the varying height of varying users. Again, to lock upper member 201 to lower member 205, one need only align holes 222 in upper end 206 of lower member with a corresponding pair of aligned holes 220 in upper member 201, and then concurrently apply pin 221 therethrough the aligned holes to pin upper member 201 to lower member 205. To adjust the overall length of support 94 when set to a preselected length with the support locking assembly, one need only remove pin 221 by hand, telescopingly adjust upper member 201 relative to lower member 205 to a preselected overall length of support 94 aligning the pair of aligned holes 222 in upper end 206 of lower member 205 with a preselected pair of aligned holes 220 in upper member 201, and then concurrently apply pin 221 therethrough the aligned holes to pin upper member 201 to lower member 205.

Figure 13:
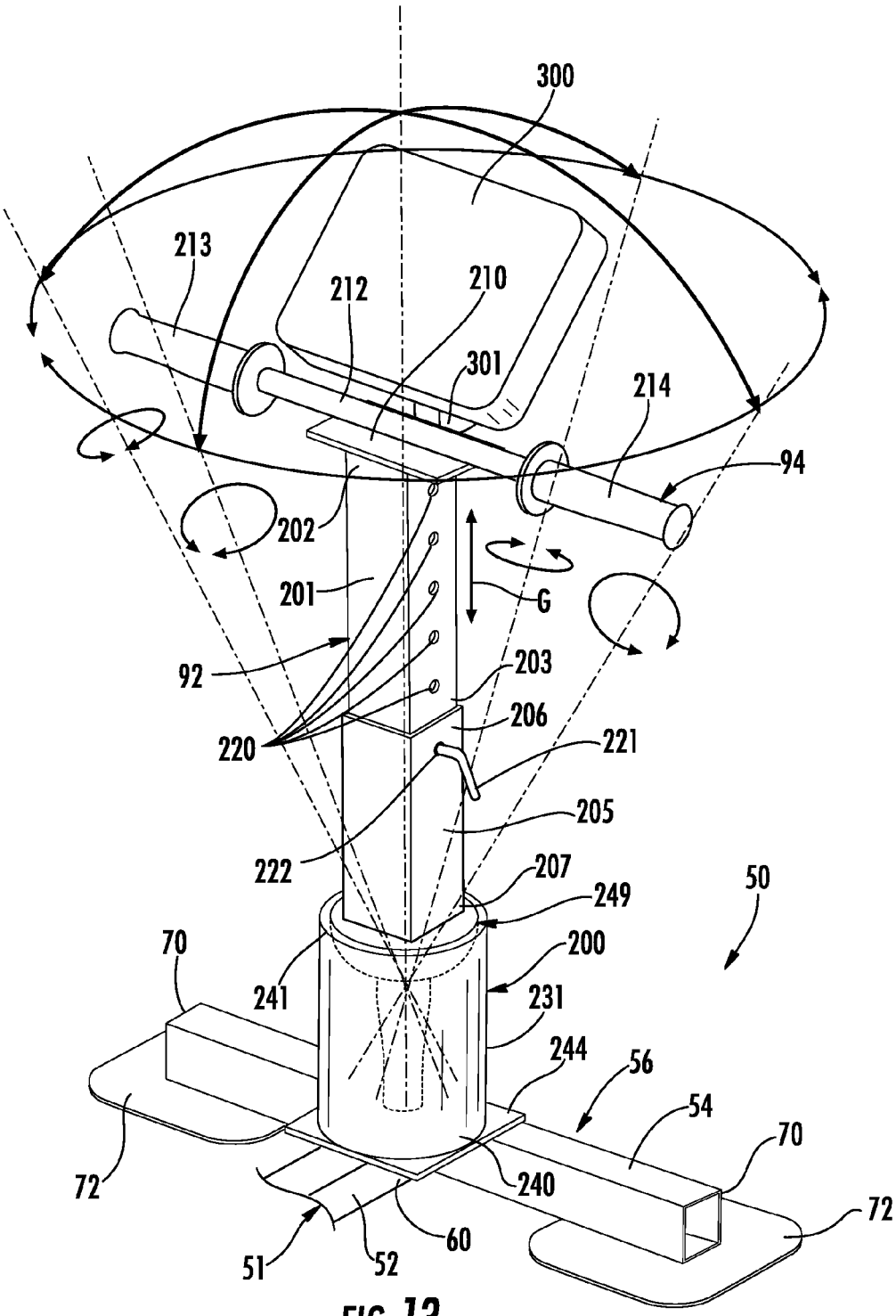
FIG. 13 is an enlarged fragmentary view corresponding to FIG. 1 illustrating the handle assembly carried by the support, and a pedestal assembly connecting the support to the front end of the base and that permits the support to sway and to rotate.

Pedestal assembly 200 is coupled between lower end 207 of lower member 205 and front end 56 of base 51. Pedestal assembly 200 couples support 94 to front end 56 of base 51, and permits support 94 to sway, to move to and fro in all directions, and to rotate about its longitudinal axis. Pedestal assembly includes elastomeric body 230 coupled between lower end 207 of lower member 205 of support 94 and a fixture 231 mounted to front end 56 of base 51. In FIG. 13, fixture 231 is a container that includes lower end 240, upper end 241, and volume 242 in FIG. 14 filled with elastomeric body 230. Lower end 240 is rigidly affixed via welding to plate 244 which, in turn, is rigidly affixed via welding to the top side of front transverse member 54 and front longitudinal member 52 at a central location equidistant with respect to free ends 70 of front transverse member 54 at the intersection of outer end 60 of front longitudinal member 52 and front transverse member 54. Fixture 231 extends upright from lower end 240 affixed to plate 244 to upper end 241.

Figure 14:
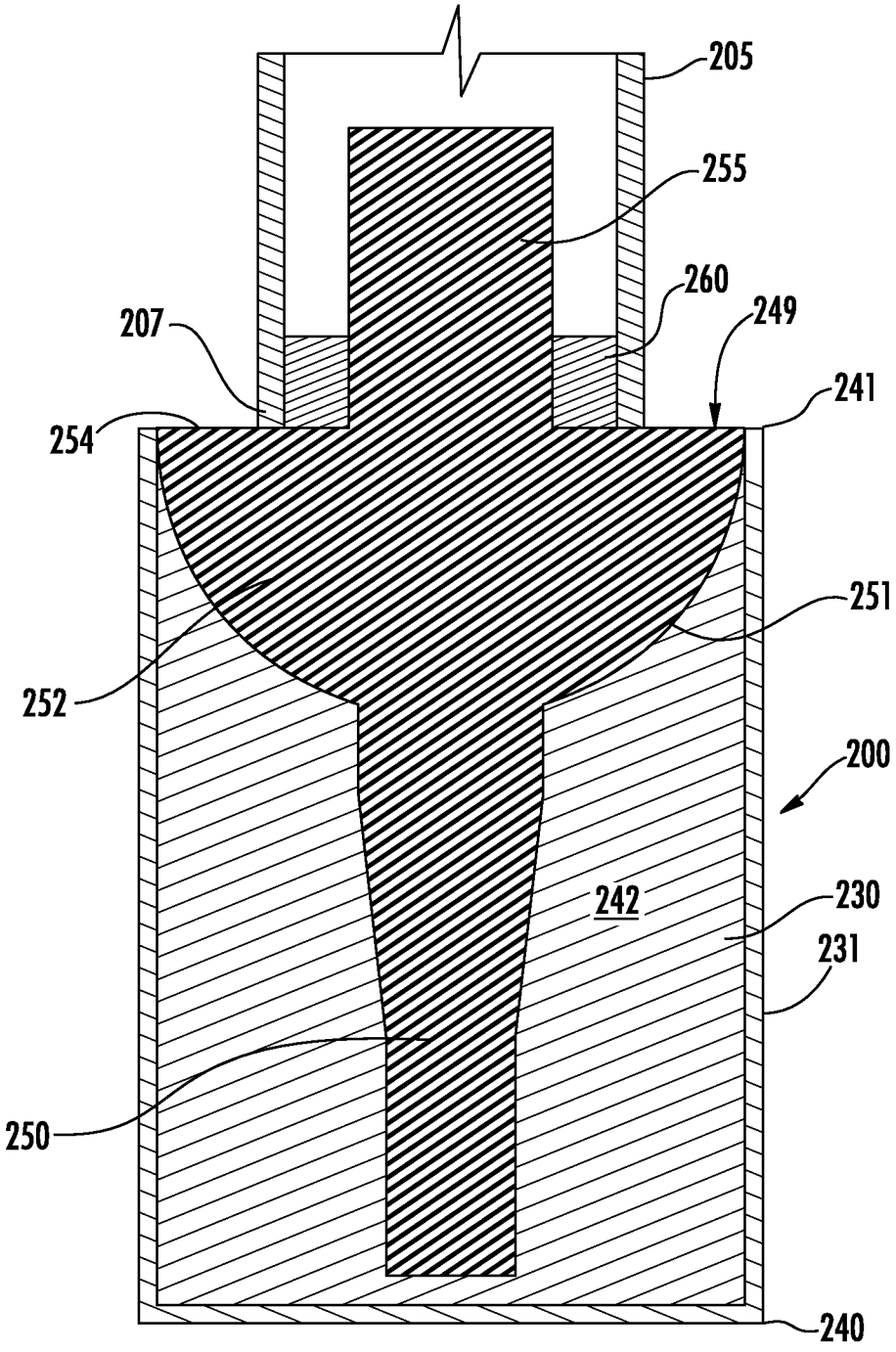
FIG. 14 is a section view taken along line 14-14 of FIG. 1.
Figure 15:
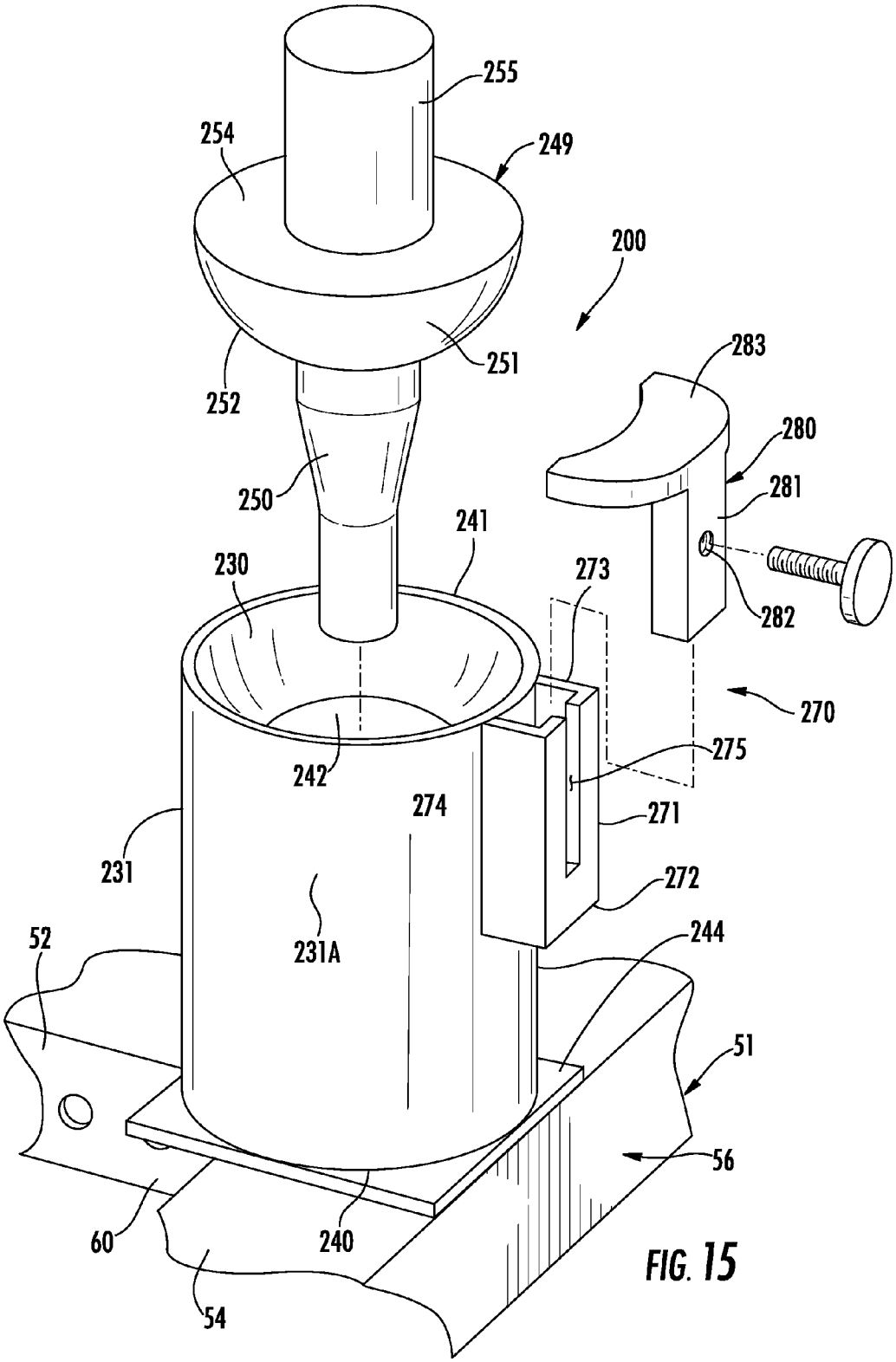
FIG. 15 is a partially exploded enlarged, fragmentary view of the pedestal assembly corresponding to the illustration of FIG. 13, the pedestal assembly includes a fixture, an elastomeric body, and a clamp assembly.

In FIGS. 14 and 15, lower end 207 of lower member 205 is formed with boot 249. Boot 249 is an extension of lower end 207 of lower member 205, and is considered to be a part of lower end 207 of lower member 205. Boot 249 is coupled to elastomeric body 230 in volume 242 of fixture 231. Elastomeric body 230 resiliently couples boot 249 of lower member 205 to fixture 231. Elastomeric body 230 interacts between boot 249 and fixture 231, permitting support 94 to sway, to move to and fro in all directions, and to rotate about its longitudinal axis, in response to forces applied to handle assembly 92 by the user.

Boot 250 is fashioned of metal, plastic, or other equivalent strong durable material having inherent rigid and resilient properties, and is integrally formed and includes annular stem 250 that depends downward centrally from hemispherical surface 251 of hemispherical body 252. Hemispherical body 252 and stem 250 extend into volume 242 through upper end 241 of fixture 231, and are embedded in elastomeric body 230 in volume 242 of fixture 231 in FIG. 14. Boot 249 extends upwardly through volume 242 from stem 250 to flat top 254 of hemispherical body 252 at upper end 241 of fixture 231. The inner surfaces of elastomeric body 230 are contoured to stem 250 and hemispherical surface 251 embedded therein. Boot 249 is rigidly connected to lower end 207 of lower member 205. In this embodiment, boot 249 has a central lug 255 that extends upright from flat top 254 into lower end 207 of lower member 205. Lower end 207 of lower member 205 is positioned directly against flat top 254 of hemispherical body 252 of boot 249. A tight-fitting collar 260 rigidly affixed via welding or press fitting in lower end 207 of lower member 205 encircles and secures central lug 25 rigidly securing lower end 207 of support 91 to boot 249. Support 94 extends upright from lower end 207, positioned on flat top 254 and secured to lug 255 via collar 260 formed in lower end 207 of lower member 205, to handle assembly 92 at upper end 202 of upper member 201 in FIG. 13.

Figure 16:
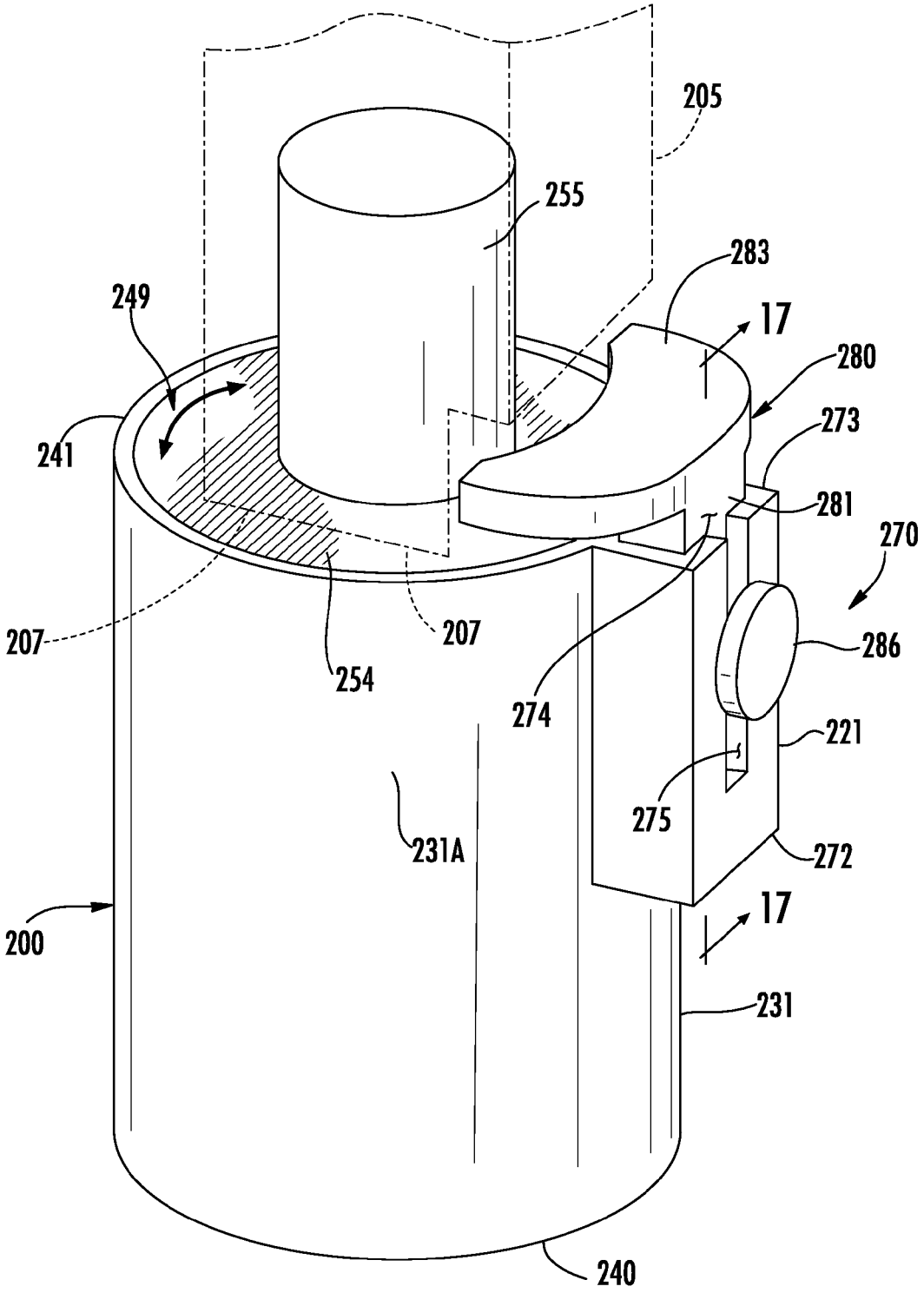
FIG. 16 is view corresponding to the illustration of FIG. 15 illustrating the pedestal assembly as it would appear assembled.
Figure 17:
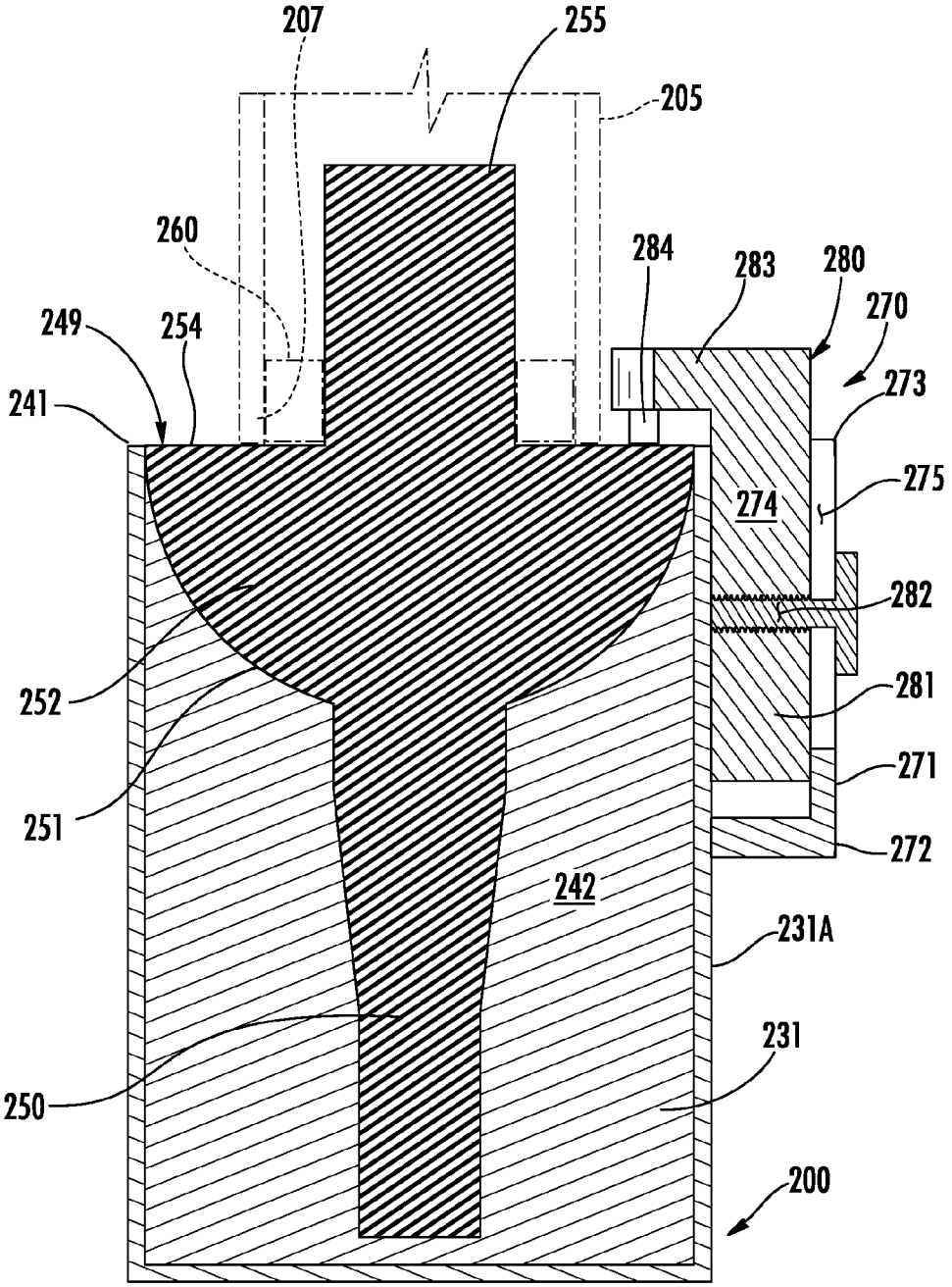
FIG. 17 is a section view taken along line 17-17 of FIG. 16.
Figure 18:
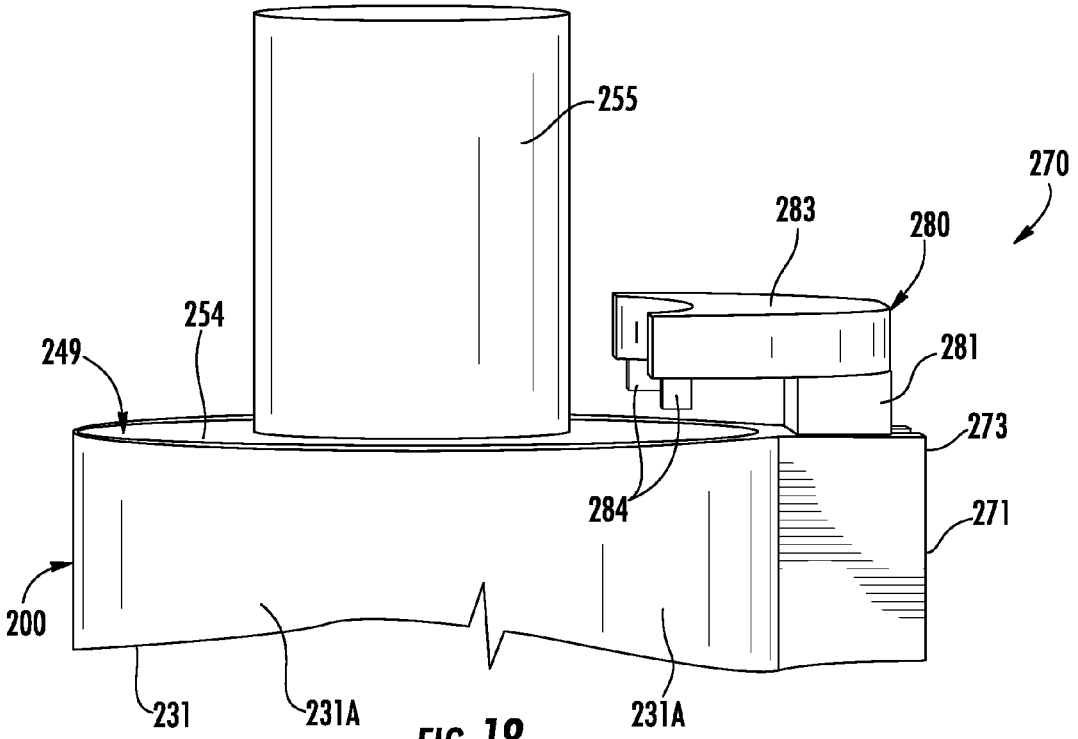
FIG. 18 is an enlarged, fragmentary view corresponding to FIG. 15 illustrating the clamp assembly in an unclamped position unlocking the elastomeric body from the fixture.
Figure 19:
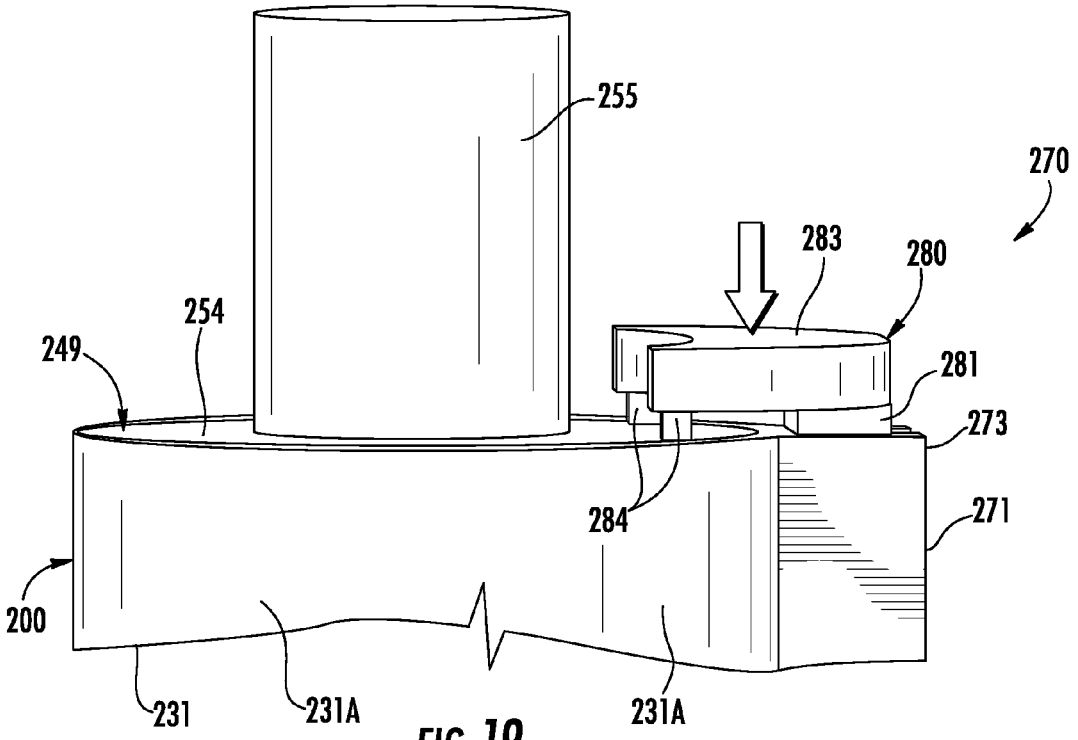
FIG. 19 is a view similar to that of FIG. 18 illustrating the clamp assembly in clamped position locking the elastomeric body to the fixture.

Pedestal assembly 200 has a clamp assembly 270 for locking boot 249 in volume 242. In FIGS. 15-17, clamp assembly 270 includes sleeve 271 affixed via welding to outer surface 231A of fixture 231 near upper end 241. Sleeve 271 has closed bottom 272 and an opposed open top 273 at upper end 241 of fixture 231 that leads to a socket or receiving area 274 between sleeve 271 and outer surface 231A of fixture 231 that extends from open top 273 to closed bottom 272. Sleeve 270 is partially vertically severed with a gap 275 to receiving area 274, the gap 275 extends from open top 273 to near closed bottom 272. A bracket 280 has lower end 281 with a central threaded opening 282 formed therethrough, and laterally extending upper end 283 having a pair of downwardly depending teeth 284. Referencing FIGS. 15-17 in relevant part, with upper end 283 of bracket 280 extending laterally inwardly lower end 281 is inserted into receiving area 274 of sleeve 271 and bracket 280 is pressed downwardly until teeth 284 are urged into direct contact against flat top 254 of hemispherical body 252 of boot 249 in FIGS. 17 and 19 in a locking position of bracket 280. To secure bracket 280 in the locking position to lock boot 249 in place in volume 242 with bracket 280, a headed set screw 286 is threaded into threaded opening 182 aligned with gap 275 and is tightened via rotation against the outer surface of fixture 231 securing lower end 281 within receiving area 274 between the outer surface of fixture 231 and sleeve 271. To unlock boot 249 from volume 242, this operation need only be reversed. As a matter of illustration and reference, FIG. 18 illustrates bracket 280 of clamp assembly 270 as it would appear in an unlocking position with upper end 283, including teeth 284, spaced above flat top 254 of boot 249 in an unclamped position of clamp assembly 270 unlocking boot 249 from volume 242 of fixture 231. FIGS. 17 and 19 illustrates bracket 280 of clamp assembly 270 as it would appear in the locking position with teeth 284 urged downwardly in direct contact against flat top 254 of boot 249 in the clamped position of clamp assembly 270 locking boot 249 to volume 242 of fixture 231.

Elastomeric body 230 is a compliant coupling between boot 249 of lower end 207 of upright support 94 and fixture 231 of pedestal assembly 200. Elastomeric body 230 deflects, deforms and flexes with the movement of boot 249 of lower end 207 of upright support 94 in response to forces applied to upright support 94 from a user gripping left and right grips 213 and 214 with his left and right hands causing upright support 94, and handle assembly 92 carried by upright support 94, to sway back-and-forth and to the left and to the right and in all directions therebetween depending on the applied forces. Absent such forces, the inherent shape memory characteristic of elastomeric body 230 acts on boot 249 to reset upright support 94 to its upright, at-rest position. Boot 249 can rotate back-and-forth in clockwise and counterclockwise directions in volume 242 relative to elastomeric body 230 in response to twisting forces applied to upright support 94 from a user gripping left and right grips 213 and 214 with his left and right hands causing upright support 94 and boot 249 to concurrently rotate about the long axis of upright support 94 from lower end 207 to upper end 202 permitting handle assembly 92 to, in turn, rotate. Elastomeric body 230 imparts instability to upright support 94, causing it to sway and to rotate in response to forces applied from a user gripping left and right grips 213 and 214.

In use, exercise apparatus 50 the length of base 51 and the height of handle assembly 92 are adjusted to accommodate the user's individual height, and framework 90 is set to a preselected angle of inclination. In the example in FIG. 20, base 51 is set to its lengthened condition, handle assembly 92 is set to its raised position, and framework 90 is set to its intermediate inclined position. Athlete 290 faces upright support 94 and handle assembly 92, grasps left and right grips 213 and 214 with his left and right hands, respectively, places his left foot atop left foot support 130, and places his right foot atop right foot support 131. Facing upright support 94 and handle assembly 92, using his arms, shoulders, legs, and core muscles the athlete 290 braces, stabilizes, and raises his body between his left and right hands gripping the left and right grips 213 and 214, his left foot placed upon left foot support 130 and his right foot placed upon right foot support 131, and substantially all of his force will be transferred to left and right handles 213 and 214 and left and right foot supports 130 and 131. The athlete 290 proceeds to pump his left and right legs back-and-forth sliding left and right foot supports 130 and 131 back and forth in reciprocal directions relative to handle assembly 92 and opposite to one another along the lengths of the respective left and right side tracks 120 and 121 of framework 90 while bracing himself gripping handles 213 and 214 of handle assembly 92. Substantially all of his weight and force will be transferred to handles 213 and 214 and left and right foot supports 130 and 131. As the athlete pumps his legs back and forth, his force and weight will be transferred from and between left foot support 130 and right foot support 131, which will cause framework 90 to pivot side-to-side about longitudinal axis Y between its right tilted position, shown in FIG. 20, and its left tilted position. The pivoting action of framework 90 that occurs in response to the back-and-forth transfer of the weight of athlete 290 as he pumps his legs back-and-forth reciprocating left and right foot supports 130 and 131 back and forth will inherently produce imbalance forcing the user to enlist his hand, arm, shoulder, back, core, and leg muscles to stabilize his body for strengthening the muscles throughout the athlete's hands, arms, shoulders, back, core, and legs. Moreover, as the athlete pumps his legs back and forth, his force and weight will also be transferred from and between left handle 213 and right handle 214, which will cause upright support 94 to sway back-and-forth and to the left and to the right and in directions therebetween, and also to rotate. As handle assembly 92 and support 94 concurrently displace, i.e., sway and rotate, in response to the forces and weight of athlete 290 as athlete pumps his legs back and forth, the athlete is forced to use his hands, arms, shoulders, back, core, and legs due to the resulting imbalance to stabilize himself to keep from falling off exercise apparatus 50 for strengthening the muscles throughout the athlete's hands, arms, shoulders, back, core, and legs, and for developing balance. The instability provided by the swaying and rotating upright support 94 and handle assembly 92 and the tilting of framework 90 to the left and to the right will cause the athlete to enlist his overall body muscles to keep himself stable during the described exercise movement for working and strengthening his overall body muscles and for developing balance. After dismounting exercise apparatus 50 at the completion of the use of exercise apparatus 50, the bias applied to framework 90 from coupling assembly 140 urges framework 90 into its normal or at-rest position in preparation for re-use of exercise apparatus 50.

Figure 20:
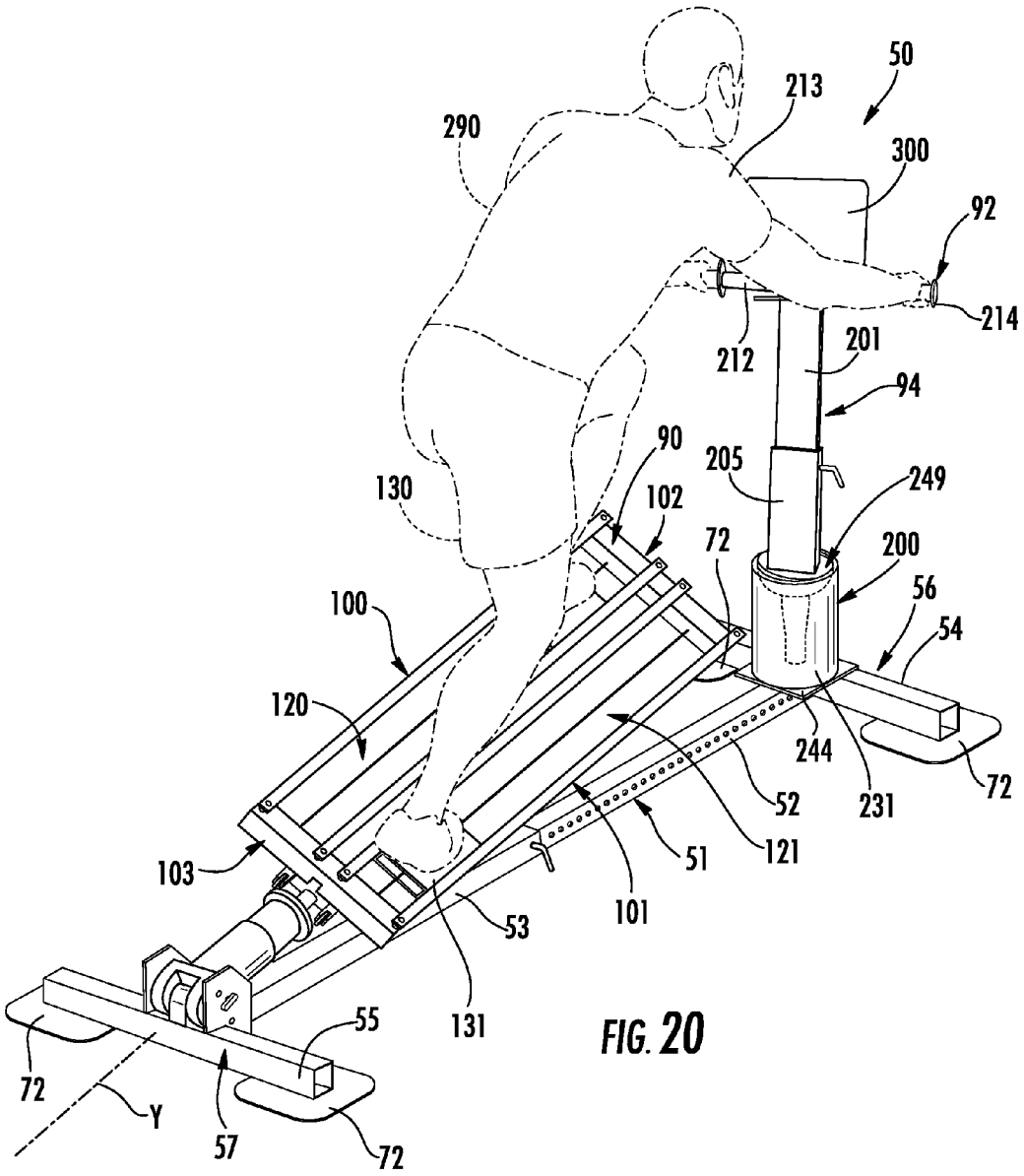
FIG. 20 is a view of the embodiment of FIG. 1 shown as it would appear in use.

In FIG. 20 framework 90 is shown in its intermediate inclined position providing an intermediate level of resistance and difficulty. Framework 90 can be set to the lowered inclined position indicated by dashed line position 90A in FIG. 3 for providing a lower level of resistance and difficulty compared to the intermediate inclined position of framework 90. Framework 90 can be set to the raised inclined position indicated by dashed line position 90B in FIG. 3 for providing a higher level of resistance and difficulty compared to the intermediate inclined position of framework 90.

Apparatus 50 can be provided with an electrified display 300 connected to upper end 202 of upper member 201 with bracket 301. Display 300, which is located above and angled forwardly relative to handle assembly 92 between left and right grips 213 and 214 can be configured to present pertinent information to athlete 290 during his use of exercise apparatus 50. For instance, display 300 can be configured to present the degree of inclination of framework 90, left and right foot support 130 and 131 repetitions performed, or other pertinent information. Display 300 can be configured to display multimedia entertainment, such as audio/visual entertainment, and/or play music, in order to keep the athlete 290 entertained during his workout.

Figure 21:
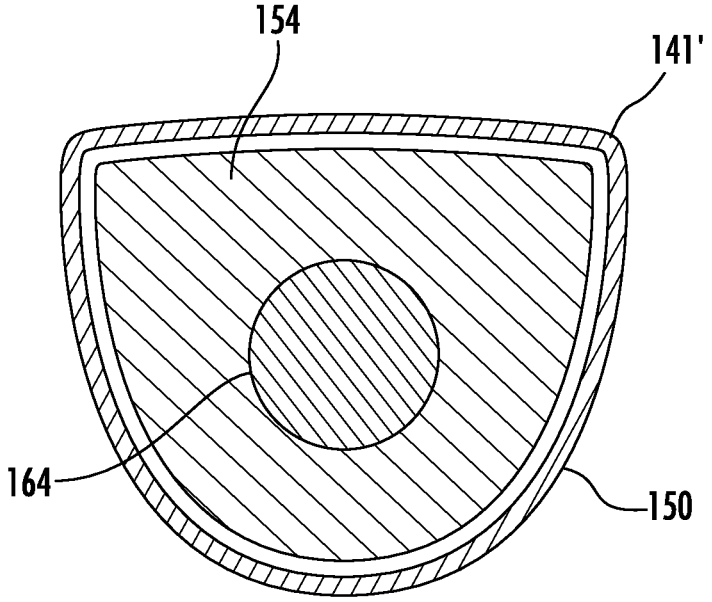
FIG. 21 is a vertical section view of alternate embodiment of a cylinder assembly for use with the embodiment of FIG. 1.

As explained above, the interaction between cylinder 150 has a key 174 of cylinder 150 and longitudinal groove 175 of piston 154 allows piston 154 to reciprocate relative to cylinder 150 and prevents piston 154 from rotating relative to rod 164 and cylinder 150 about axis Y. There can be other ways to prevent piston 154 from rotating relative to rod 164 and cylinder 150. For instance, FIG. 21 is a section view of an alternate embodiment of cylinder assembly 141', here denoted with a prime ("") symbol for clarity. Cylinder assembly 141' is identical in every respect to cylinder assembly 141 with two exceptions. First, cylinder assembly 141' has no anti-rotation tongue-and-groove assembly. Secondly, cylinder 150 and piston 154 having complementing shapes that prevent piston 154 from rotating relative to rod 164 and cylinder 150. In this example, cylinder 150 and piston 154 having complementing "D" shapes to prevent is an alternate embodiment of cylinder assembly 141 to prevent piston 154 from rotating relative to rod 164 and cylinder 150.

The invention has been described above with reference to illustrative embodiments. However, those skilled in the art will recognize that changes and modifications can be made to the embodiments without departing from the nature and scope of the invention. Various changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. An exercise apparatus, comprising:

a base includes a rear end and a front end;

a fixture mounted to the front end of the base;

a support extends upright from the fixture and supports a handle assembly disposed at an elevated location relative to the front end of the base;

an elastomeric body coupled between the support and the fixture, the elastomeric body imparts instability to the support enabling the support and the handle to concurrently sway in all directions and to rotate relative to the fixture;

a framework, the framework includes a rear end and a front end, a length from the rear end of the framework to the front end of the framework, is between the rear end of the base and the front end of the base, is mounted to the rear end of the base for movement of the framework between a lowered inclined position relative to the rear end of the base and a raised inclined position relative to the rear end of the base, and extends forwardly from the rear end of the framework proximate to the rear end of the base to the front end of the framework toward the handle assembly;

the framework includes a first side track and a second side track, the first and second side tracks are parallel relative to one another and extend along the length of the framework from the rear end of the framework to the front end of the framework; and first and second foot supports each mounted to the first and second side tracks, respectively, of the framework for movement in reciprocal directions relative to the handle assembly along first and second stroke paths, respectively, wherein the first and second stroke paths are defined by the first and second side tracks, respectively, extend along the length of the framework from the rear end of the framework to the front end of the framework, and are parallel relative to one another.

2. The exercise apparatus according to claim 1, further comprising a framework locking assembly for selectively retaining the framework in the lowered inclined position and the raised inclined position.

3. The exercise apparatus according to claim 1, wherein the support is adjustable between a shortened condition and a lengthened condition.

4. The exercise apparatus according to claim 3, further comprising a support locking assembly for selectively retaining the support in the shortened condition and the lengthened condition.

5. The exercise apparatus according to claim 1, wherein the fixture comprises a container, the container is filled with the elastomeric body, and an extension of the support is embedded in the elastomeric body.

6. The exercise apparatus according to claim 1, wherein the base is adjustable between a shortened condition for moving the framework toward the handle assembly, and a lengthened condition for moving the framework away from the handle assembly.

7. The exercise apparatus according to claim 6, further comprising a base locking assembly for selectively retaining the base in the shortened condition and the lengthened condition.

8. An exercise apparatus, comprising:

a base includes a rear end and a front end;

a support extends upright from the front end of the base and supports a handle assembly disposed at an elevated location relative to the front end of the base;

a framework, the framework includes a rear end and a front end, a length from the rear end of the framework to the front end of the framework, is between the rear end of the base and the front end of the base, is mounted to the rear end of the base for side-to-side pivotal movement of the framework relative to a normal position of the framework about a longitudinal axis, and extends forwardly from the rear end of the framework proximate to the rear end of the base to the front end of the framework toward the handle assembly;

the framework includes a first side track and a second side track, the first and second side tracks are on either side of the longitudinal axis, are parallel relative to one another, and extend along the length of the framework from the rear end of the framework to the front end of the framework; and first and second foot supports each mounted to the first and second side tracks, respectively, of the framework on either side of the longitudinal axis for movement in reciprocal directions relative to the handle assembly along first and second stroke paths, respectively, wherein the first and second stroke paths are defined by the first and second side tracks, respectively, extend along the length of the framework from the rear end of the framework to the front end of the framework, are on either side of the longitudinal axis, and are parallel relative to one another.

9. The exercise apparatus according to claim 8, further comprising a bias applied to the framework tending to urge the framework toward the normal position.

10. The exercise apparatus according to claim 8, wherein the support is adjustable between a shortened condition and a lengthened condition.

11. The exercise apparatus according to claim 10, further comprising a support locking assembly for selectively retaining the support in the shortened condition and the lengthened condition.

12. The exercise apparatus according to claim 8, further comprising:

a fixture mounted to the front end of the base;

the support extends upright from the fixture to the handle assembly; and an elastomeric body coupled between the support and the fixture, the elastomeric body imparts instability to the support enabling the support and the handle to concurrently sway in all directions and to rotate relative to the fixture.

13. The exercise apparatus according to claim 12, wherein the fixture comprises a container, the container is filled with the elastomeric body, and an extension of the support is embedded in the elastomeric body.

14. The exercise apparatus according to claim 8, wherein the base is adjustable between a shortened condition for moving the framework toward the handle assembly, and a lengthened condition for moving the framework away from the handle assembly.

15. The exercise apparatus according to claim 14, further comprising a base locking assembly for selectively retaining the base in the shortened condition and the lengthened condition.

16. An exercise apparatus, comprising:

a base includes a rear end and a front end;

a support extends upright from the front end of the base and supports a handle assembly disposed at an elevated location relative to the front end of the base;

a framework, the framework includes a rear end and a front end, a length from the rear end of the framework to the front end of the framework, is between the rear end of the base and the front end of the base, is mounted to the rear end of the base for movement of the framework between a lowered inclined position relative to the rear end of the base and a raised inclined position relative to the rear end of the base, and for side-to-side pivotal movement of the framework about a longitudinal axis, and extends forwardly from the rear end of the framework proximate to the rear end of the base to the front end of the framework toward the handle assembly;

the framework includes a first side track and a second side track, the first and second side tracks are on either side of the longitudinal axis, are parallel relative to one another, and extend along the length of the framework from the rear end of the framework to the front end of the framework; and first and second foot supports each mounted to the first and second side tracks, respectively, of the framework on either side of the longitudinal axis for movement in reciprocal directions relative to the handle assembly along first and second stroke paths, respectively, wherein the first and second stroke paths are defined by the first and second side tracks, respectively, extend along the length of the framework from the rear end of the framework to the front end of the framework, are on either side of the longitudinal axis, and are parallel relative to one another.

17. The exercise apparatus according to claim 16, further comprising a bias applied to the framework tending to urge the framework toward the normal position.

18. The exercise apparatus according to claim 16, further comprising a framework locking assembly for selectively retaining the framework in the lowered inclined position and the raised inclined position.

19. The exercise apparatus according to claim 16, wherein the support is adjustable between a shortened condition and a lengthened condition.

20. The exercise apparatus according to claim 19, further comprising a support locking assembly for selectively retaining the support in the shortened condition and the lengthened condition.

21. The exercise apparatus according to claim 16, further comprising:

a fixture mounted to the front end of the base;

the support extends upright from the fixture to the handle assembly; and an elastomeric body coupled between the support and the fixture, the elastomeric body imparts instability to the support enabling the support and the handle to concurrently sway in all directions and to rotate relative to the fixture.

22. The exercise apparatus according to claim 21, wherein the fixture comprises a container, the container is filled with the elastomeric body, and an extension of the support is embedded in the elastomeric body.

23. The exercise apparatus according to claim 16, wherein the base is adjustable between a shortened condition for moving the framework toward the handle assembly, and a lengthened condition for moving the framework away from the handle assembly.

24. The exercise apparatus according to claim 23, further comprising a base locking assembly for selectively retaining the base in the shortened condition and the lengthened condition.

* * * * *